US007791290B2

(12) United States Patent
Gorrell et al.

(10) Patent No.: US 7,791,290 B2
(45) Date of Patent: Sep. 7, 2010

(54) ULTRA-SMALL RESONATING CHARGED PARTICLE BEAM MODULATOR

(75) Inventors: Jonathan Gorrell, Gainesville, FL (US); Mark Davidson, Florahome, FL (US); Michael E. Maines, Gainesville, FL (US); Paul Hart, Kansas City, MO (US)

(73) Assignee: Virgin Islands Microsystems, Inc., Saint Thomas (VG)

( * ) Notice: Subject to any disclaimer, the term of this patent is extended or adjusted under 35 U.S.C. 154(b) by 0 days.

(21) Appl. No.: 11/238,991

(22) Filed: Sep. 30, 2005

(65) Prior Publication Data

US 2007/0075263 A1 Apr. 5, 2007

(51) Int. Cl.
*H05H 7/00* (2006.01)

(52) U.S. Cl. ..... 315/501; 315/505; 315/506

(58) Field of Classification Search ..... 315/1, 315/500–507, 5.34–5.36, 5.39, 5.41, 5.43; 250/396 R, 423 R, 493.1, 495.1, 397
See application file for complete search history.

(56) References Cited

U.S. PATENT DOCUMENTS

| | | | |
|---|---|---|---|
| 1,948,384 | A | 2/1934 | Lawrence |
| 2,307,086 | A | 1/1943 | Varian et al. |
| 2,431,396 | A | 11/1947 | Hansell |
| 2,473,477 | A | 6/1949 | Smith |
| 2,634,372 | A | 4/1953 | Salisbury ..... 315/1 |
| 2,932,798 | A | 4/1960 | Kerst et al. |
| 2,944,183 | A | 7/1960 | Drexler |
| 2,966,611 | A | 12/1960 | Sandstrom |
| 3,231,779 | A | 1/1966 | White |
| 3,274,428 | A | 9/1966 | Harris |
| 3,297,905 | A | 1/1967 | Rockwell et al. |
| 3,315,117 | A | 4/1967 | Udelson |
| 3,387,169 | A | 6/1968 | Farney |
| 3,543,147 | A | 11/1970 | Kovarik |
| 3,546,524 | A | 12/1970 | Stark |
| 3,560,694 | A | 2/1971 | White |
| 3,571,642 | A | 3/1971 | Westcott |
| 3,586,899 | A | 6/1971 | Fleisher |

(Continued)

FOREIGN PATENT DOCUMENTS

EP 0237559 B1 12/1991

(Continued)

OTHER PUBLICATIONS

Gallerano, G.P. et al., "Overview of Terahertz Radiation Sources," Proceedings of the 2004 FEL Conference, pp. 216-221.

(Continued)

*Primary Examiner*—Douglas W Owens
*Assistant Examiner*—Tung X Le
(74) *Attorney, Agent, or Firm*—Davidson Berquist Jackson & Gowdey LLP

(57) ABSTRACT

A method and apparatus for modulating a beam of charged particles is described in which a beam of charged particles is produced by a particle source and a varying electric field is induced within an ultra-small resonant structure. The beam of charged particles is modulated by the interaction of the varying electric field with the beam of charged particles.

27 Claims, 11 Drawing Sheets

U.S. PATENT DOCUMENTS

| | | | | |
|---|---|---|---|---|
| 3,761,828 | A | | 9/1973 | Pollard et al. |
| 3,886,399 | A | | 5/1975 | Symons |
| 3,923,568 | A | | 12/1975 | Bersin |
| 3,989,347 | A | | 11/1976 | Eschler |
| 4,053,845 | A | | 10/1977 | Gould |
| 4,269,672 | A | | 5/1981 | Inoue |
| 4,282,436 | A | | 8/1981 | Kapetanakos |
| 4,296,354 | A | | 10/1981 | Neubauer |
| 4,450,554 | A | | 5/1984 | Steensma et al. |
| 4,453,108 | A | | 6/1984 | Freeman, Jr. |
| 4,482,779 | A | | 11/1984 | Anderson |
| 4,528,659 | A | | 7/1985 | Jones, Jr. |
| 4,589,107 | A | | 5/1986 | Middleton et al. |
| 4,598,397 | A | | 7/1986 | Nelson et al. |
| 4,630,262 | A | | 12/1986 | Callens et al. |
| 4,652,703 | A | | 3/1987 | Lu et al. |
| 4,661,783 | A | | 4/1987 | Gover et al. |
| 4,704,583 | A | | 11/1987 | Gould |
| 4,712,042 | A | | 12/1987 | Hamm |
| 4,713,581 | A | | 12/1987 | Haimson |
| 4,727,550 | A | | 2/1988 | Chang et al. |
| 4,740,963 | A | | 4/1988 | Eckley |
| 4,740,973 | A | | 4/1988 | Madey |
| 4,746,201 | A | | 5/1988 | Gould |
| 4,761,059 | A | | 8/1988 | Yeh et al. |
| 4,782,485 | A | | 11/1988 | Gollub |
| 4,789,945 | A | | 12/1988 | Niijima |
| 4,806,859 | A | | 2/1989 | Hetrick |
| 4,809,271 | A | | 2/1989 | Kondo et al. |
| 4,813,040 | A | | 3/1989 | Futato |
| 4,819,228 | A | | 4/1989 | Baran et al. |
| 4,829,527 | A | | 5/1989 | Wortman et al. |
| 4,838,021 | A | | 6/1989 | Beattie |
| 4,841,538 | A | | 6/1989 | Yanabu et al. |
| 4,864,131 | A | | 9/1989 | Rich et al. |
| 4,866,704 | A | | 9/1989 | Bergman |
| 4,866,732 | A | | 9/1989 | Carey et al. |
| 4,873,715 | A | | 10/1989 | Shibata |
| 4,887,265 | A | | 12/1989 | Felix |
| 4,890,282 | A | | 12/1989 | Lambert et al. |
| 4,898,022 | A | | 2/1990 | Yumoto et al. |
| 4,912,705 | A | | 3/1990 | Paneth et al. |
| 4,932,022 | A | | 6/1990 | Keeney et al. |
| 4,981,371 | A | | 1/1991 | Gurak et al. |
| 5,023,563 | A | | 6/1991 | Harvey et al. |
| 5,036,513 | A | | 7/1991 | Greenblatt |
| 5,065,425 | A | | 11/1991 | Lecomte et al. |
| 5,113,141 | A | | 5/1992 | Swenson |
| 5,121,385 | A | | 6/1992 | Tominaga et al. |
| 5,127,001 | A | | 6/1992 | Steagall et al. |
| 5,128,729 | A | | 7/1992 | Alonas et al. |
| 5,130,985 | A | | 7/1992 | Kondo et al. |
| 5,150,410 | A | | 9/1992 | Bertrand |
| 5,155,726 | A | | 10/1992 | Spinney et al. |
| 5,157,000 | A | | 10/1992 | Elkind et al. |
| 5,163,118 | A | | 11/1992 | Lorenzo et al. |
| 5,185,073 | A | | 2/1993 | Bindra |
| 5,187,591 | A | | 2/1993 | Guy et al. |
| 5,199,918 | A | | 4/1993 | Kumar |
| 5,214,650 | A | | 5/1993 | Renner et al. |
| 5,233,623 | A | | 8/1993 | Chang |
| 5,235,248 | A | | 8/1993 | Clark et al. |
| 5,262,656 | A | | 11/1993 | Blondeau et al. |
| 5,263,043 | A | | 11/1993 | Walsh |
| 5,268,693 | A | | 12/1993 | Walsh |
| 5,268,788 | A | | 12/1993 | Fox et al. |
| 5,282,197 | A | | 1/1994 | Kreitzer |
| 5,283,819 | A | | 2/1994 | Glick et al. |
| 5,293,175 | A | | 3/1994 | Hemmie et al. |
| 5,302,240 | A | | 4/1994 | Hori et al. ..... 438/719 |
| 5,305,312 | A | | 4/1994 | Fornek et al. |
| 5,341,374 | A | | 8/1994 | Lewen et al. |
| 5,354,709 | A | | 10/1994 | Lorenzo et al. |
| 5,446,814 | A | | 8/1995 | Kuo et al. |
| 5,485,277 | A | | 1/1996 | Foster |
| 5,504,341 | A | | 4/1996 | Glavish |
| 5,578,909 | A | | 11/1996 | Billen |
| 5,604,352 | A | | 2/1997 | Schuetz |
| 5,608,263 | A | | 3/1997 | Drayton et al. |
| 5,637,966 | A | | 6/1997 | Umstadter et al. |
| 5,663,971 | A | | 9/1997 | Carlsten |
| 5,666,020 | A | | 9/1997 | Takemura |
| 5,668,368 | A | * | 9/1997 | Sakai et al. ..... 250/251 |
| 5,705,443 | A | | 1/1998 | Stauf et al. |
| 5,737,458 | A | | 4/1998 | Wojnarowski et al. |
| 5,744,919 | A | * | 4/1998 | Mishin et al. ..... 315/505 |
| 5,757,009 | A | * | 5/1998 | Walstrom ..... 250/396 R |
| 5,767,013 | A | | 6/1998 | Park |
| 5,780,970 | A | | 7/1998 | Singh et al. |
| 5,790,585 | A | | 8/1998 | Walsh |
| 5,811,943 | A | | 9/1998 | Mishin et al. |
| 5,821,836 | A | | 10/1998 | Katehi et al. |
| 5,821,902 | A | | 10/1998 | Keen |
| 5,825,140 | A | | 10/1998 | Fujisawa |
| 5,831,270 | A | * | 11/1998 | Nakasuji ..... 250/396 ML |
| 5,847,745 | A | | 12/1998 | Shimizu et al. |
| 5,858,799 | A | | 1/1999 | Yee et al. |
| 5,889,449 | A | | 3/1999 | Fiedziuszko |
| 5,889,797 | A | | 3/1999 | Nguyen |
| 5,902,489 | A | * | 5/1999 | Yasuda et al. ..... 210/748 |
| 5,963,857 | A | | 10/1999 | Greywall |
| 5,972,193 | A | | 10/1999 | Chou et al. |
| 6,005,347 | A | | 12/1999 | Lee |
| 6,008,496 | A | | 12/1999 | Winefordner et al. |
| 6,040,625 | A | | 3/2000 | Ip |
| 6,060,833 | A | * | 5/2000 | Velazco ..... 315/5.41 |
| 6,080,529 | A | | 6/2000 | Ye et al. |
| 6,117,784 | A | | 9/2000 | Uzoh |
| 6,139,760 | A | | 10/2000 | Shim et al. |
| 6,180,415 | B1 | | 1/2001 | Schultz et al. |
| 6,195,199 | B1 | | 2/2001 | Yamada |
| 6,210,555 | B1 | | 4/2001 | Taylor et al. |
| 6,222,866 | B1 | | 4/2001 | Seko |
| 6,278,239 | B1 | | 8/2001 | Caporaso et al. |
| 6,281,769 | B1 | | 8/2001 | Fiedziuszko |
| 6,297,511 | B1 | | 10/2001 | Syllaios et al. |
| 6,301,041 | B1 | | 10/2001 | Yamada |
| 6,303,014 | B1 | | 10/2001 | Taylor et al. |
| 6,309,528 | B1 | | 10/2001 | Taylor et al. |
| 6,316,876 | B1 | | 11/2001 | Tanabe |
| 6,338,968 | B1 | | 1/2002 | Hefti |
| 6,370,306 | B1 | | 4/2002 | Sato et al. ..... 385/129 |
| 6,373,194 | B1 | | 4/2002 | Small |
| 6,376,258 | B2 | | 4/2002 | Hefti |
| 6,407,516 | B1 | | 6/2002 | Victor |
| 6,441,298 | B1 | | 8/2002 | Thio |
| 6,448,850 | B1 | | 9/2002 | Yamada |
| 6,453,087 | B2 | | 9/2002 | Frish et al. |
| 6,470,198 | B1 | | 10/2002 | Kintaka et al. |
| 6,504,303 | B2 | | 1/2003 | Small |
| 6,524,461 | B2 | | 2/2003 | Taylor et al. |
| 6,525,477 | B2 | | 2/2003 | Small |
| 6,534,766 | B2 | | 3/2003 | Abe et al. |
| 6,545,425 | B2 | | 4/2003 | Victor |
| 6,552,320 | B1 | | 4/2003 | Pan |
| 6,577,040 | B2 | | 6/2003 | Nguyen |
| 6,580,075 | B2 | | 6/2003 | Kametani et al. |
| 6,603,781 | B1 | | 8/2003 | Stinson et al. |
| 6,603,915 | B2 | | 8/2003 | Glebov et al. |
| 6,624,916 | B1 | | 9/2003 | Green et al. |
| 6,636,185 | B1 | | 10/2003 | Spitzer et al. |
| 6,636,534 | B2 | | 10/2003 | Madey et al. |
| 6,636,653 | B2 | | 10/2003 | Miracky et al. |
| 6,640,023 | B2 | | 10/2003 | Miller et al. |

6,642,907 B2 11/2003 Hamada et al.
6,687,034 B2 2/2004 Wine et al.
6,700,748 B1 3/2004 Cowles et al.
6,724,486 B1 4/2004 Shull et al.
6,738,176 B2 5/2004 Rabinowitz et al.
6,741,781 B2 5/2004 Furuyama
6,777,244 B2 8/2004 Pepper et al.
6,782,205 B2 8/2004 Trisnadi et al.
6,791,438 B2 9/2004 Takahashi et al.
6,800,877 B2 10/2004 Victor et al.
6,801,002 B2 10/2004 Victor et al.
6,819,432 B2 11/2004 Pepper et al.
6,829,286 B1 12/2004 Guilfoyle et al.
6,834,152 B2 12/2004 Gunn et al.
6,870,438 B1 3/2005 Shino et al.
6,871,025 B2 3/2005 Maleki et al.
6,885,262 B2 4/2005 Nishimura et al.
6,900,447 B2 5/2005 Gerlach et al.
6,908,355 B2 6/2005 Habib et al.
6,909,092 B2 6/2005 Nagahama
6,909,104 B1 6/2005 Koops
6,924,920 B2 8/2005 Zhilkov
6,936,981 B2 8/2005 Gesley
6,943,650 B2 9/2005 Ramprasad et al.
6,944,369 B2 9/2005 Deliwala
6,952,492 B2 10/2005 Tanaka et al.
6,953,291 B2 10/2005 Liu
6,954,515 B2 10/2005 Bjorkholm et al.
6,965,284 B2 11/2005 Maekawa et al.
6,965,625 B2 11/2005 Mross et al.
6,972,439 B1 12/2005 Kim et al.
6,995,406 B2 2/2006 Tojo et al.
7,010,183 B2 3/2006 Estes et al.
7,064,500 B2 6/2006 Victor et al.
7,068,948 B2 6/2006 Wei et al.
7,092,588 B2 8/2006 Kondo
7,092,603 B2 8/2006 Glebov et al.
7,098,615 B2 * 8/2006 Swenson et al. ..... 315/505
7,099,586 B2 8/2006 Yoo
7,120,332 B1 10/2006 Spoonhower et al.
7,122,978 B2 * 10/2006 Nakanishi et al. ..... 315/500
7,130,102 B2 10/2006 Rabinowitz
7,177,515 B2 2/2007 Estes et al.
7,194,798 B2 3/2007 Bonhote et al.
7,230,201 B1 6/2007 Miley et al.
7,253,426 B2 8/2007 Gorrell et al.
7,267,459 B2 9/2007 Matheson
7,267,461 B2 9/2007 Kan et al.
7,309,953 B2 12/2007 Tiberi et al.
7,342,441 B2 3/2008 Gorrell et al.
7,359,589 B2 4/2008 Gorrell et al.
7,361,916 B2 4/2008 Gorrell et al.
7,362,972 B2 4/2008 Yavor et al.
7,375,631 B2 5/2008 Moskowitz et al.
7,436,177 B2 10/2008 Gorrell et al.
7,442,940 B2 10/2008 Gorrell et al.
7,443,358 B2 10/2008 Gorrell et al.
7,459,099 B2 12/2008 Kubena et al.
7,470,920 B2 12/2008 Gorrell et al.
7,473,917 B2 1/2009 Singh
7,554,083 B2 6/2009 Gorrell et al.
7,569,836 B2 8/2009 Gorrell
7,573,045 B2 8/2009 Gorrell et al.
7,586,097 B2 9/2009 Gorrell et al.
7,586,167 B2 9/2009 Gorrell et al.
2001/0002315 A1 5/2001 Schultz et al.
2001/0025925 A1 * 10/2001 Abe et al. ..... 250/307
2001/0045360 A1 11/2001 Omasa
2002/0009723 A1 1/2002 Hefti
2002/0027481 A1 3/2002 Fiedziuszko
2002/0036121 A1 3/2002 Ball et al.
2002/0036264 A1 3/2002 Nakasuji et al.
2002/0053638 A1 * 5/2002 Winkler et al. ..... 250/306
2002/0056645 A1 5/2002 Taylor et al.
2002/0068018 A1 6/2002 Pepper et al.
2002/0070671 A1 6/2002 Small
2002/0071457 A1 6/2002 Hogan
2002/0122531 A1 * 9/2002 Whitham ..... 378/137
2002/0135665 A1 9/2002 Gardner
2002/0139961 A1 10/2002 Kinoshita et al.
2002/0158295 A1 10/2002 Armgarth et al.
2002/0191650 A1 12/2002 Madey et al.
2003/0010979 A1 1/2003 Pardo
2003/0012925 A1 1/2003 Gorrell
2003/0016412 A1 1/2003 Eilenberger et al.
2003/0016421 A1 1/2003 Small
2003/0034535 A1 2/2003 Barenburu et al.
2003/0103150 A1 6/2003 Catrysse et al.
2003/0106998 A1 * 6/2003 Colbert et al. ..... 250/306
2003/0155521 A1 8/2003 Feuerbaum
2003/0158474 A1 8/2003 Scherer et al.
2003/0164947 A1 9/2003 Vaupel
2003/0179974 A1 9/2003 Estes et al.
2003/0206708 A1 11/2003 Estes et al.
2003/0214695 A1 11/2003 Abramson et al.
2003/0222579 A1 12/2003 Habib et al.
2004/0011432 A1 1/2004 Podlaha et al.
2004/0061053 A1 4/2004 Taniguchi et al.
2004/0080285 A1 4/2004 Victor et al.
2004/0085159 A1 5/2004 Kubena et al.
2004/0092104 A1 5/2004 Gunn, III et al.
2004/0108471 A1 6/2004 Luo et al.
2004/0108473 A1 * 6/2004 Melnychuk et al. ..... 250/504 R
2004/0108823 A1 * 6/2004 Amaldi et al. ..... 315/505
2004/0136715 A1 7/2004 Kondo
2004/0150991 A1 8/2004 Ouderkirk et al.
2004/0154925 A1 8/2004 Podlaha et al.
2004/0171272 A1 9/2004 Jin et al. ..... 438/708
2004/0180244 A1 9/2004 Tour et al.
2004/0184270 A1 9/2004 Halter
2004/0213375 A1 * 10/2004 Bjorkholm et al. ..... 378/58
2004/0217297 A1 11/2004 Moses et al.
2004/0218651 A1 11/2004 Iwasaki et al.
2004/0231996 A1 11/2004 Webb
2004/0240035 A1 12/2004 Zhilkov
2004/0264867 A1 12/2004 Kondo
2005/0023145 A1 2/2005 Cohen et al.
2005/0045821 A1 3/2005 Noji et al.
2005/0045832 A1 3/2005 Kelly et al.
2005/0054151 A1 3/2005 Lowther et al.
2005/0062903 A1 3/2005 Cok et al.
2005/0067286 A1 3/2005 Ahn et al.
2005/0082469 A1 * 4/2005 Carlo ..... 250/262
2005/0092929 A1 5/2005 Schneiker
2005/0104684 A1 5/2005 Wojcik
2005/0105595 A1 5/2005 Martin et al.
2005/0105690 A1 5/2005 Pau et al.
2005/0145882 A1 7/2005 Taylor et al.
2005/0152635 A1 7/2005 Paddon et al.
2005/0162104 A1 7/2005 Victor et al.
2005/0180678 A1 8/2005 Panepucci et al.
2005/0190637 A1 9/2005 Ichimura et al.
2005/0191055 A1 9/2005 Maruyama et al.
2005/0194258 A1 9/2005 Cohen et al.
2005/0201707 A1 9/2005 Glebov et al.
2005/0201717 A1 9/2005 Matsumura et al.
2005/0206314 A1 9/2005 Habib et al.
2005/0212503 A1 * 9/2005 Deibele ..... 324/71.3
2005/0231138 A1 10/2005 Nakanishi et al.
2005/0249451 A1 11/2005 Baehr-Jones et al.
2005/0285541 A1 12/2005 LeChevalier
2006/0007730 A1 1/2006 Nakamura et al.
2006/0018619 A1 1/2006 Helffrich et al.
2006/0035173 A1 2/2006 Davidson et al.
2006/0045418 A1 3/2006 Cho et al.
2006/0050269 A1 3/2006 Brownell

| | | | | |
|---|---|---|---|---|
| 2006/0060782 | A1 | 3/2006 | Khursheed | |
| 2006/0062258 | A1 | 3/2006 | Brau et al. | 372/2 |
| 2006/0131176 | A1 | 6/2006 | Hsu | |
| 2006/0131695 | A1 | 6/2006 | Kuekes et al. | |
| 2006/0159131 | A1 | 7/2006 | Liu et al. | |
| 2006/0164496 | A1 | 7/2006 | Tokutake et al. | |
| 2006/0187794 | A1 | 8/2006 | Harvey et al. | |
| 2006/0208667 | A1 | 9/2006 | Lys et al. | |
| 2006/0216940 | A1 | 9/2006 | Gorrell et al. | |
| 2006/0232364 | A1 | 10/2006 | Koh et al. | |
| 2006/0243925 | A1 | 11/2006 | Barker et al. | |
| 2006/0274922 | A1 | 12/2006 | Ragsdale | |
| 2007/0003781 | A1 | 1/2007 | de Rochemont | |
| 2007/0013765 | A1 | 1/2007 | Hudson et al. | |
| 2007/0075263 | A1 | 4/2007 | Gorrell et al. | |
| 2007/0075264 | A1 | 4/2007 | Gorrell et al. | |
| 2007/0085039 | A1 | 4/2007 | Gorrell et al. | |
| 2007/0086915 | A1 | 4/2007 | LeBoeuf et al. | |
| 2007/0116420 | A1 | 5/2007 | Estes et al. | |
| 2007/0146704 | A1 | 6/2007 | Schmidt et al. | |
| 2007/0152176 | A1 | 7/2007 | Gorrell et al. | |
| 2007/0154846 | A1 | 7/2007 | Gorrell et al. | |
| 2007/0194357 | A1 | 8/2007 | Oohashi | |
| 2007/0200940 | A1 | 8/2007 | Gruhlke et al. | |
| 2007/0238037 | A1 | 10/2007 | Wuister et al. | |
| 2007/0252983 | A1 | 11/2007 | Tong et al. | |
| 2007/0258492 | A1 | 11/2007 | Gorrell | |
| 2007/0258689 | A1 | 11/2007 | Gorrell et al. | |
| 2007/0258690 | A1 | 11/2007 | Gorrell et al. | |
| 2007/0258720 | A1 | 11/2007 | Gorrell et al. | |
| 2007/0259641 | A1 | 11/2007 | Gorrell et al. | |
| 2007/0264023 | A1 | 11/2007 | Gorrell et al. | |
| 2007/0264030 | A1 | 11/2007 | Gorrell et al. | |
| 2007/0282030 | A1 | 12/2007 | Anderson et al. | |
| 2007/0284527 | A1 | 12/2007 | Zani et al. | |
| 2008/0069509 | A1 | 3/2008 | Gorrell et al. | |
| 2008/0218102 | A1 | 9/2008 | Sliski et al. | |
| 2008/0283501 | A1 | 11/2008 | Roy | |
| 2008/0302963 | A1 | 12/2008 | Nakasuji et al. | |

FOREIGN PATENT DOCUMENTS

| | | | |
|---|---|---|---|
| JP | 2004-32323 | A | 1/2004 |
| WO | WO 87/01873 | | 3/1987 |
| WO | WO 93/21663 | A1 | 10/1993 |
| WO | WO 98/021788 | | 5/1998 |
| WO | WO 00/72413 | | 11/2000 |
| WO | WO 02/25785 | | 3/2002 |
| WO | WO 02/077607 | | 10/2002 |
| WO | WO 2004/086560 | | 10/2004 |
| WO | WO 2005/015143 | A2 | 2/2005 |
| WO | WO 2005/098966 | | 10/2005 |
| WO | WO 2006/042239 | A2 | 4/2006 |
| WO | WO 2007/081389 | | 7/2007 |
| WO | WO 2007/081390 | | 7/2007 |
| WO | WO 2007/081391 | | 7/2007 |

OTHER PUBLICATIONS

Goldstein, M. et al., "Demonstration of a Micro Far-Infrared Smith-Purcell Emitter," Applied Physics Letters, Jul. 28, 1997, pp. 452-454, vol. 71 No. 4, American Institute of Physics.

Gover, A. et al., "Angular Radiation Pattern of Smith-Purcell Radiation," Journal of the Optical Society of America, Oct. 1984, pp. 723-728, vol. 1 No. 5, Optical Society of America.

Grishin, Yu. A. et al., "Pulsed Orotron—A New Microwave Source for Submillimeter Pulse High-Field Electron Paramagnetic Resonance Spectroscopy," Review of Scientific Instruments, Sep. 2004, pp. 2926-2936, vol. 75 No. 9, American Institute of Physics.

Ishizuka, H. et al., "Smith-Purcell Experiment Utilizing a Field-Emitter Array Cathode: Measurements of Radiation," Nuclear Instruments and Methods in Physics Research, 2001, pp. 593-598, A 475, Elsevier Science B.V.

Ishizuka, H. et al., "Smith-Purcell Radiation Experiment Using a Field-Emission Array Cathode," Nuclear Instruments and Methods in Physics Research, 2000, pp. 276-280, A 445, Elsevier Science B.V.

Ives, Lawrence et al., "Development of Backward Wave Oscillators for Terahertz Applications," Terahertz for Military and Security Applications, Proceedings of SPIE vol. 5070 (2003), pp. 71-82.

Ives, R. Lawrence, "IVEC Summary, Session 2, Sources I" 2002.

Joo, Youngcheol et al., "Fabrication of Monolithic Microchannels for IC Chip Cooling," 1995, Mechanical, Aerospace and Nuclear Engineering Department, University of California at Los Angeles.

Jung, K.B. et al., "Patterning of Cu, Co, Fe, and Ag for magnetic nanostructures," J. Vac. Sci. Technol. A 15(3), May/Jun. 1997, pp. 1780-1784.

Schachter, Levi et al., "Smith-Purcell Oscillator in an Exponential Gain Regime," Journal of Applied Physics, Apr. 15, 1989, pp. 3267-3269, vol. 65 No. 8, American Institute of Physics.

Schachter, Levi, "Influence of the Guiding Magnetic Field on the Performance of a Smith-Purcell Amplifier Operating in the Weak Compton Regime," Journal of the Optical Society of America, May 1990, pp. 873-876, vol. 7 No. 5, Optical Society of America.

Schachter, Levi, "The Influence of the Guided Magnetic Field on the Performance of a Smith-Purcell Amplifier Operating in the Strong Compton Regime," Journal of Applied Physics, Apr. 15, 1990, pp. 3582-3592, vol. 67 No. 8, American Institute of Physics.

Shih, I. et al., "Experimental Investigations of Smith-Purcell Radiation," Journal of the Optical Society of America, Mar. 1990, pp. 351-356, vol. 7, No. 3, Optical Society of America.

Shih, I. et al., "Measurements of Smith-Purcell Radiation," Journal of the Optical Society of America, Mar. 1990, pp. 345-350, vol. 7 No. 3, Optical Society of America.

Swartz, J.C. et al., "THz-FIR Grating Coupled Radiation Source," Plasma Science, 1998. 1D02, p. 126.

Temkin, Richard, "Scanning with Ease Through the Far Infrared," Science, New Series, May 8, 1998, p. 854, vol. 280, No. 5365, American Association for the Advancement of Science.

Walsh, J.E., et al., 1999. From website: http://www.ieee.org/organizations/pubs/newsletters/leos/feb99/hot2.htm.

Wentworth, Stuart M. et al., "Far-Infrared Composite Microbolometers," IEEE MTT-S Digest, 1990, pp. 1309-1310.

Yamamoto, N. et al., "Photon Emission From Silver Particles Induced by a High-Energy Electron Beam," Physical Review B, Nov. 6, 2001, pp. 205419-1-205419-9, vol. 64, The American Physical Society.

Yokoo, K. et al., "Smith-Purcell Radiation at Optical Wavelength Using a Field-Emitter Array," Technical Digest of IVMC, 2003, pp. 77-78.

Zeng, Yuxiao et al., "Processing and encapsulation of silver patterns by using reactive ion etch and ammonia anneal," Materials Chemistry and Physics 66, 2000, pp. 77-82.

Jonietz, Erika, "Nano Antenna Gold nanospheres show path to all-optical computing," Technology Review, Dec. 2005/Jan. 2006, p. 32.

Joo, Youngcheol et al., "Air Cooling of IC Chip with Novel Microchannels Monolithically Formed on Chip Front Surface," Cooling and Thermal Design of Electronic Systems (HTD-vol. 319 & EEP-vol. 15), International Mechanical Engineering Congress and Exposition, San Francisco, CA, Nov. 1995, pp. 117-121.

Mokhoff, Nicolas, "Optical-speed light detector promises fast space talk," EETimes Online, Mar. 20, 2006, from website: www.eetimes.com/showArticle.jhtml?articleID=183701047.

S. Hoogland et al., "A solution-processed 1.53 μm quantum dot laser with temperature-invariant emission wavelength," Optics Express, vol. 14, No. 8, Apr. 17, 2006, pp. 3273-3281.

Lee Kwang-Cheol et al., "Deep X-Ray Mask with Integrated Actuator for 3D Microfabrication", Conference: Pacific Rim Workshop on Transducers and Micro/Nano Technologies, (Xiamen CHN), Jul. 22, 2002.

Markoff, John, "A Chip That Can Transfer Data Using Laser Light," The New York Times, Sep. 18, 2006.

S.M. Sze, "Semiconductor Devices Physics and Technology", 2nd Edition, Chapters 9 and 12, Copyright 1985, 2002.

Search Report and Written Opinion mailed Feb. 12, 2007 in corresponding PCT Appln. No. PCT/US2006/022682.

Search Report and Written Opinion mailed Feb. 20, 2007 in corresponding PCT Appln. No. PCT/US2006/022676.
Search Report and Written Opinion mailed Feb. 20, 2007 in corresponding PCT Appln. No. PCT/US2006/022772.
Search Report and Written Opinion mailed Feb. 20, 2007 in corresponding PCT Appln. No. PCT/US2006/022780.
Search Report and Written Opinion mailed Feb. 21, 2007 in corresponding PCT Appln. No. PCT/US2006/022684.
Search Report and Written Opinion mailed Jan. 17, 2007 in corresponding PCT Appln. No. PCT/US2006/022777.
Search Report and Written Opinion mailed Jan. 23, 2007 in corresponding PCT Appln. No. PCT/US2006/022781.
U.S. Appl. No. 11/418,082, filed May 5, 2006, Gorrell et al.
"Notice of Allowability" mailed on Jan. 17, 2008 in U.S. Appl. No. 11/418,082, filed May 5, 2006.
J. C. Palais, "Fiber optic communications," Prentice Hall, New Jersey, 1998, pp. 156-158.
Search Report and Written Opinion mailed Dec. 20, 2007 in PCT Appln. No. PCT/US2006/022771.
Search Report and Written Opinion mailed Jan. 31, 2008 in PCT Appln. No. PCT/US2006/027427.
Search Report and Written Opinion mailed Jan. 8, 2008 in PCT Appln. No. PCT/US2006/028741.
Search Report and Written Opinion mailed Mar. 11, 2008 in PCT Appln. No. PCT/US2006/022679.
Search Report and Written Opinion mailed Aug. 24, 2007 in PCT Appln. No. PCT/US2006/022768.
Search Report and Written Opinion mailed Aug. 31, 2007 in PCT Appln. No. PCT/US2006/022680.
Search Report and Written Opinion mailed Jul. 16, 2007 in PCT Appln. No. PCT/US2006/022774.
Search Report and Written Opinion mailed Jul. 20, 2007 in PCT Appln. No. PCT/US2006/024216.
Search Report and Written Opinion mailed Jul. 26, 2007 in PCT Appln. No. PCT/US2006/022776.
Search Report and Written Opinion mailed Jun. 20, 2007 in PCT Appln. No. PCT/US2006/022779.
Search Report and Written Opinion mailed Sep. 12, 2007 in PCT Appln. No. PCT/US2006/022767.
Search Report and Written Opinion mailed Sep. 13, 2007 in PCT Appln. No. PCT/US2006/024217.
Search Report and Written Opinion mailed Sep. 17, 2007 in PCT Appln. No. PCT/US2006/022787.
Search Report and Written Opinion mailed Sep. 5, 2007 in PCT Appln. No. PCT/US2006/027428.
Search Report and Written Opinion mailed Sep. 17, 2007 in PCT Appln. No. PCT/US2006/022689.
International Search Report and Written Opinion mailed Nov. 23, 2007 in International Application No. PCT/US2006/022786.
Search Report and Written Opinion mailed Oct. 25, 2007 in PCT Appln. No. PCT/US2006/022687.
Search Report and Written Opinion mailed Oct. 26, 2007 in PCT Appln. No. PCT/US2006/022675.
Search Report and Written Opinion mailed Sep. 21, 2007 in PCT Appln. No. PCT/US2006/022688.
Search Report and Written Opinion mailed Sep. 25, 2007 in PCT appln. No. PCT/US2006/022681.
Search Report and Written Opinion mailed Sep. 26, 2007 in PCT Appin. No. PCT/US2006/024218.
Search Report and Written Opinion mailed Apr. 23, 2008 in PCT Appln. No. PCT/US2006/022678.
Search Report and Written Opinion mailed Apr. 3, 2008 in PCT Appln. No. PCT/US2006/027429.
Search Report and Written Opinion mailed Jun. 18, 2008 in PCT Appln. No. PCT/US2006/027430.
Search Report and Written Opinion mailed Jun. 3, 2008 in PCT Appln. No. PCT/US2006/022783.
Search Report and Written Opinion mailed Mar. 24, 2008 in PCT Appln. No. PCT/US2006/022677.
Search Report and Written Opinion mailed Mar. 24, 2008 in PCT Appln. No. PCT/US2006/022784.
Search Report and Written Opinion mailed May 2, 2008 in PCT Appln. No. PCT/US2006/023280.
Search Report and Written Opinion mailed May 21, 2008 in PCT Appln. No. PCT/US2006/023279.
Search Report and Written Opinion mailed May 22, 2008 in PCT Appln. No. PCT/US2006/022685.
Neo et al., "Smith-Purcell Radiation from Ultraviolet to Infrared Using a Si-field Emitter" Vacuum Electronics Conference, 2007, IVEC '07, IEEE International May 2007.
Search Report and Writen Opinion mailed Jul. 14, 2008 in PCT Appln. No. PCT/US2006/022773.
Search Report and Written Opinion mailed Aug. 19, 2008 in PCT Appln. No. PCT/US2007/008363.
Search Report and Written Opinion mailed Jul. 16, 2008 in PCT Appln. No. PCT/US2006/022766.
Search Report and Written Opinion mailed Jul. 28, 2008 in PCT Appln. No. PCT/US2006/022782.
Search Report and Written Opinion mailed Jul. 3, 2008 in PCT Appln. No. PCT/US2006/022690.
Search Report and Written Opinion mailed Jul. 3, 2008 in PCT Appln. No. PCT/US2006/022778.
Search Report and Written Opinion mailed Jul. 7, 2008 in PCT Appln. No. PCT/US2006/022686.
Search Report and Written Opinion mailed Jul. 7, 2008 in PCT Appln. No. PCT/US2006/022785.
Search Report and Written Opinion mailed Sep. 2, 2008 in PCT Appln. No. PCT/US2006/022769.
Search Report and Written Opinion mailed Sep. 26, 2008 in PCT Appln. No. PCT/US2007/00053.
Search Report and Written Opinion mailed Sep. 3, 2008 in PCT Appln. No. PCT/US2006/022770.
"An Early History—Invention of the Klystron," http://varianinc.com/cgi-bin/advprint/print.cgi?cid=KLQNPPJJFJ, printed on Dec. 26, 2008.
"An Early History—The Founding of Varian Associates," http://varianinc.com/cgi-bin/advprint/print.cgi?cid=KLQNPPJJFJ, printed on Dec. 26, 2008.
"Chapter 3 E-Ray Tube," http://compepid.tuskegee.edu/syllabi/clinical/small/radiology/chapter . . . , printed from tuskegee.edu on Dec. 29, 2008.
"Diagnostic imaging modalities—Ionizing vs non-ionizing radiation," http://info.med.yale.edu/intmed/cardio/imaging/techniques/ionizing_v . . . , printed from Yale University School of Medicine on Dec. 29, 2008.
"Klystron Amplifier," http://www.radartutorial.eu/08.transmitters/tx12.en.html, printed on Dec. 26, 2008.
"Klystron is a Micowave Generator," http://www2.slac.stanford.edu/vvc/accelerators/klystron.html, printed on Dec. 26, 2008.
"Klystron," http:en.wikipedia.org/wiki/Klystron, printed on Dec. 26, 2008.
"Frequently Asked Questions," Luxtera Inc., found at http://www.luxtera.com/technology_faq.htm, printed on Dec. 2, 2005, 4 pages.
"Technology Overview," Luxtera, Inc., found at http://www.luxtera.com/technology.htm, printed on Dec. 2, 2005, 1 page.
Mar. 24, 2006 PTO Office Action in U.S. Appl. No. 10/917,511.
Mar. 25, 2008 PTO Office Action in U.S. Appl. No. 11/411,131.
Apr. 8, 2008 PTO Office Action in U.S. Appl. No. 11/325,571.
Apr. 17, 2008 Response to PTO Office Action of Dec. 20, 2007 in U.S. Appl. No. 11/418,087.
Apr. 19, 2007 Response to PTO Office Action of Jan. 17, 2007 in U.S. Appl. No. 11/418,082.
May 10, 2005 PTO Office Action in U.S. Appl. No. 10/917,511.
May 21, 2007 PTO Office Action in U.S. Appl. No. 11/418,087.
May 26, 2006 Response to PTO Office Action of Mar. 24, 2006 in U.S. Appl. No. 10/917,511.
Jun. 16, 2008 Response to PTO Office Action of Dec. 14, 2007 in U.S. Appl. No. 11/418,264.
Jun. 20, 2008 Response to PTO Office Action of Mar. 25, 2008 in U.S. Appl. No. 11/411,131.
Aug. 14, 2006 PTO Office Action in U.S. Appl. No. 10/917,511.
Sep. 1, 2006 Response to PTO Office Action of Aug. 14, 2006 in U.S. Appl. No. 10/917,511.
Sep. 12, 2005 Response to PTO Office Action of May 10, 2005 in U.S. Appl. No. 10/917,511.
Sep. 14, 2007 PTO Office Action in U.S. Appl. No. 11/411,131.

Oct. 19, 2007 Response to PTO Office Action of May 21, 2007 in U.S. Appl. No. 11/418,087.
Dec. 4, 2006 PTO Office Action in U.S. Appl. No. 11/418,087.
Dec. 14, 2007 PTO Office Action in U.S. Appl. No. 11/418,264.
Dec. 14, 2007 Response to PTO Office Action of Sep. 14, 2007 in U.S. Appl. No. 11/411,131.
Dec. 20, 2007 PTO Office Action in U.S. Appl. No. 11/418,087.
Corcoran, Elizabeth, "Ride the Light," Forbes Magazine, Apr. 11, 2005, pp. 68-70.
European Search Report mailed Mar. 3, 2009 in European Application No. 06852028.7.
Saraph, Girish P. et al., "Design of a Single-Stage Depressed Collector for High-Power, Pulsed Gyroklystrom Amplifiers," IEEE Transactions on Electron Devices, vol. 45, No. 4, Apr. 1998, pp. 986-990.
Sartori, Gabriele, "CMOS Photonics Platform," Luxtera, Inc., Nov. 2005, 19 pages.
U.S. Appl. No. 11/203,407—Nov. 13, 2008 PTO Office Action.
U.S. Appl. No. 11/243,477—Apr. 25, 2008 PTO Office Action.
U.S. Appl. No. 11/243,477—Oct. 24, 2008 Response to PTO Office Action of Apr. 25, 2008.
U.S. Appl. No. 11/243,477—Jan. 7, 2009 PTO Office Action.
U.S. Appl. No. 11/325,448—Jun. 16, 2008 PTO Office Action.
U.S. Appl. No. 11/325,448—Dec. 16, 2008 Response to PTO Office Action of Jun. 16, 2008.
U.S. Appl. No. 11/325,534—Jun. 11, 2008 PTO Office Action.
U.S. Appl. No. 11/325,534—Oct. 15, 2008 Response to PTO Office Action of Jun. 11, 2008.
U.S. Appl. No. 11/353,208—Jan. 15, 2008 PTO Office Action.
U.S. Appl. No. 11/353,208—Mar. 17, 2008 PTO Office Action.
U.S. Appl. No. 11/353,208—Sep. 15, 2008 Response to PTO Office Action of Mar. 17, 2008.
U.S. Appl. No. 11/353,208—Dec. 24, 2008 PTO Office Action.
U.S. Appl. No. 11/353,208—Dec. 30, 2008 Response to PTO Office Action of Dec. 24, 2008.
U.S. Appl. No. 11/400,280—Oct. 16, 2008 PTO Office Action.
U.S. Appl. No. 11/400,280—Oct. 24, 2008 Response to PTO Office Action of Oct. 16, 2008.
U.S. Appl. No. 11/410,905—Sep. 26, 2008 PTO Office Action.
U.S. Appl. No. 11/410,905—Mar. 26, 2009 Response to PTO Office Action of Sep. 26, 2008.
U.S. Appl. No. 11/410,924—Mar. 6, 2009 PTO Office Action.
U.S. Appl. No. 11/411,120—Mar. 19, 2009 PTO Office Action.
U.S. Appl. No. 11/411,129—Jan. 16, 2009 Office Action.
U.S. Appl. No. 11/411,130—May 1, 2008 PTO Office Action.
U.S. Appl. No. 11/411,130—Oct. 29, 2008 Response to PTO Office Action of May 1, 2008.
U.S. Appl. No. 11/417,129 —Jul. 11, 2007 PTO Office Action.
U.S. Appl. No. 11/417,129—Dec. 17, 2007 Response to PTO Office Action of Jul. 11, 2007.
U.S. Appl. No. 11/417,129—Dec. 20, 2007 Response to PTO Office Action of Jul. 11, 2007.
U.S. Appl. No. 11/417,129—Apr. 17, 2008 PTO Office Action.
U.S. Appl. No. 11/417,129—Jun. 19, 2008 Response to PTO Office Action of Apr. 17, 2008.
U.S. Appl. No. 11/418,079—Apr. 11, 2008 PTO Office Action.
U.S. Appl. No. 11/418,079—Oct. 7, 2008 Response to PTO Office Action of Apr. 11, 2008.
U.S. Appl. No. 11/418,079—Feb. 12. 2009 PTO Office Action.
U.S. Appl. No. 11/418,080—Mar. 18, 2009 PTO Office Action.
U.S. Appl. No. 11/418,082—Jan. 17, 2007 PTO Office Action.
U.S. Appl. No. 11/418,083—2008-06-20-2008 PTO Office Action.
U.S. Appl. No. 11/418,083—Dec. 18, 2008 Response to PTO Office Action of Jun. 20, 2008.
U.S. Appl. No. 11/418,084—Nov. 5, 2007 PTO Office Action.
U.S. Appl. No. 11/418,084—May 5, 2008 Response to PTO Office Action of Nov. 5, 2007.
U.S. Appl. No. 11/418,084—Aug. 19, 2008 PTO Office Action.
U.S. Appl. No. 11/418,084—Feb. 19, 2009 Response to PTO Office Action of Aug. 19, 2008.
U.S. Appl. No. 11/418,085—Aug. 10, 2007 PTO Office Action.
U.S. Appl. No. 11/418,085—Nov. 13, 2007 Response to PTO Office Action of Aug. 10, 2007.
U.S. Appl. No. 11/418,085—Feb. 12, 2008 PTO Office Action.
U.S. Appin. No. 11/418,085—Aug. 12, 2008 Response to PTO Office Action of Feb. 12, 2008.
U.S. Appl. No. 11/418,085—Sep. 16, 2008 PTO Office Action.
U.S. Appl. No. 11/418,085—Mar. 6, 2009 Response to PTO Office Action of Sep. 16, 2008.
U.S. Appl. No. 11/418,087—Dec. 29, 2006 Response to PTO Office Action of Dec. 4, 2006.
U.S. Appl. No. 11/418,087—Feb. 15, 2007 PTO Office Action.
U.S. Appl. No. 11/418,087—Mar. 6, 2007 Response to PTO Office Action of Feb. 15, 2007.
U.S. Appl. No. 11/418,088—Jun. 9, 2008 PTO Office Action.
U.S. Appl. No. 11/418,088—Dec. 8, 2008 Response to PTO Office Action of Jun. 9, 2008.
U.S. Appl. No. 11/418,089—Mar. 21, 2008 PTO Office Action.
U.S. Appl. No. 11/418,089—Jun. 23, 2008 Response to PTO Office Action of Mar. 21, 2008.
U.S. Appl. No. 11/418,089—Sep. 30, 2008 PTO Office Action.
U.S. Appl. No. 11/418,089—Mar. 30, 2009 Response to PTO Office Action of Sep. 30, 2008.
U.S. Appl. No. 11/418,091—Jul. 30, 2007 PTO Office Action.
U.S. Appl. No. 11/418,091—Nov. 27, 2007 Response to PTO Office Action of Jul. 30, 2007.
U.S. Appl. No. 11/418,091—Feb. 26, 2008 PTO Office Action.
U.S. Appl. No. 11/418,097—Jun. 2, 2008 PTO Office Action.
U.S. Appl. No. 11/418,097—Dec. 2, 2008 Response to PTO Office Action of Jun. 2, 2008.
U.S. Appl. No. 11/418,097—Feb. 18, 2009 PTO Office Action.
U.S. Appl. No. 11/418,099—Jun. 23, 2008 PTO Office Action.
U.S. Appl. No. 11/418,099—Dec. 23, 2008 Response to PTO Office Action of Jun. 23, 2008.
U.S. Appl. No. 11/418,100—Jan. 12, 2009 PTO Office Action.
U.S. Appl. No. 11/418,123—Apr. 25, 2008 PTO Office Action.
U.S. Appl. No. 11/418,123—Oct. 27, 2008 Response to PTO Office Action of Apr. 25, 2008.
U.S. Appl. No. 11/418,123—Jan. 26, 2009 PTO Office Action.
U.S. Appl. No. 11/418,124—Oct. 1, 2008 PTO Office Action.
U.S. Appl. No. 11/418,124—Feb. 2, 2009 Response to PTO Office Action of Oct. 1, 2008.
U.S. Appl. No. 11/418,124—Mar. 13, 2009 PTO Office Action.
U.S. Appl. No. 11/418,126—Oct. 12, 2006 PTO Office Action.
U.S. Appl. No. 11/418,126—Feb. 12, 2007 Response to PTO Office Action of Oct. 12, 2006 (Redacted).
U.S. Appl. No. 11/418,126—Jun. 6, 2007 PTO Office Action.
U.S. Appl. No. 11/418,126—Aug. 6, 2007 Response to PTO Office Action of Jun. 6, 2007.
U.S. Appl. No. 11/418,126—Nov. 2, 2007 PTO Office Action.
U.S. Appl. No. 11/418,126—Feb. 22, 2008 Response to PTO Office Action of Nov. 2, 2007.
U.S. Appl. No. 11/418,126—Jun. 10, 2008 PTO Office Action.
U.S. Appl. No. 11/418,127—Apr. 2, 2009 Office Action.
U.S. Appl. No. 11/418,128—Dec. 16, 2008 PTO Office Action.
U.S. Appl. No. 11/418,128—Dec. 31, 2008 Response to PTO Office Action of Dec. 16, 2008.
U.S. Appl. No. 11/418,128—Feb. 17, 2009 PTO Office Action.
U.S. Appl. No. 11/418,129—Dec. 16, 2008 Office Action.
U.S. Appl. No. 11/418,129—Dec. 31, 2008 Response to PTO Office Action of Dec. 16, 2008.
U.S. Appl. No. 11/418,244—Jul. 1, 2008 PTO Office Action.
U.S. Appl. No. 11/418,244—Nov. 25, 2008 Response to PTO Office Action of Jul. 1, 2008.
U.S. Appl. No. 11/418,263—Sep. 24, 2008 PTO Office Action.
U.S. Appl. No. 11/418,263—Dec. 24, 2008 Response to PTO Office Action of Sep. 24, 2008.
U.S. Appl. No. 11/418,263—Mar. 9, 2009 PTO Office Action.
U.S. Appl. No. 11/418,315—Mar. 31, 2008 PTO Office Action.
U.S. Appl. No. 11/418,318—Mar. 31, 2009 PTO Office Action.
U.S. Appl. No. 11/441,219—Jan. 7, 2009 PTO Office Action.
U.S. Appl. No. 11/522,929—Oct. 22, 2007 PTO Office Action.
U.S. Appl. No. 11/522,929—Feb. 21, 2008 Response to PTO Office Action of Oct. 22, 2007.
U.S. Appl. No. 11/641,678—Jul. 22, 2008 PTO Office Action.

Bekefi et al., "Stimulated Raman Scattering by an Intense Relativistic Electron Beam Subjected to a Rippled Electron Field", Aug. 1979, J. Appl. Phys., 50(8), 5168-5164.
European Search Report mailed Nov. 2, 2009 (related to PCT/US2006/022782).
Gervasoni J.L. et al., "Plasmon Excitations in Cylindrical Wires by External Charged Particles," Physical Review B (Condensed Matter and Materials Physics) APS through AIP USA, vol. 68, No. 23, Dec. 15, 2003, pp. 235302-1, XP002548423, ISSN: 0163-1829.
Gervasoni, J.L., "Excitations of Bulk and Surface Plasmons in Solids and Nanostructures," Surface and Interface Analysis, Apr. 2006, John Wiley and Sons LTD GB, vol. 38, No. 4, Apr. 2006, pp. 583-586, XP002548422.
Rich, Alan, "Shielding and Guarding, How to Exclude Interference-type noise," Analog Dialogue 17-1, 1983.
Smith et al. "Enhanced Diffraction from a Grating on the Surface of a Negative-Index Metamaterial," Physical Review Letters, vol. 93, No. 13, 2004.
U.S. Appl. No. 11/411,129—Jan. 28, 2010 PTO Office Action.
U.S. Appl. No. 11/418,079—Jan. 7, 2010 PTO Office Action.
U.S. Appl. No. 11/418,080—Jan. 5, 2010 PTO Office Action.
U.S. Appl. No. 11/418,086—Mar. 4, 2010 PTO Office Action.
U.S. Appl. No. 11/418,128—Nov. 24, 2009 PTO Office Action.
U.S. Appl. No. 11/418,263—Dec. 9, 2009 PTO Office Action.
U.S. Appl. No. 11/418,365—Feb. 23, 2010 PTO Final Office Action.
"Notice of Allowability" mailed on Jul. 2, 2009 in U.S. Appl. No. 11/410,905, filed Apr. 26, 2006.
"Notice of Allowability" mailed on Jun. 30, 2009 in U.S. Appl. No. 11/418,084, filed May 5, 2006.
B. B Loechel et al., "Fabrication of Magnetic Microstructures by Using Thick Layer Resists", Microelectronics Eng., vol. 21, pp. 463-466 (1993).
Magellan 8500 Scanner Product Reference Guide, PSC Inc., 2004, pp. 6-27-F18.
Magellan 9500 with SmartSentry Quick Reference Guide, PSC Inc., 2004.
Response to Non-Final Office Action submitted May 13, 2009 in U.S. Appl. No. 11/203,407.
U.S. Appl. No. 11/350,812—Apr. 17, 2009 Office Action.
U.S. Appl. No. 11/411,130—Jun. 23, 2009 PTO Office Action.
U.S. Appl. No. 11/418,089—Jul. 15, 2009 PTO Office Action.
U.S. Appl. No. 11/418,096—Jun. 23, 2009 PTO Office Action.
U.S. Appl. No. 11/433,486—Jun. 19, 2009 PTO Office Action.
Brau et al., "Tribute to John E Walsh", Nuclear Instruments and Methods in Physics Research Section A. Accelerators, Spectrometers, Detectors and Associated Equipment, vol. 475, Issues 1-3, Dec. 21, 2001, pp. xiii-xiv.
Kapp, et al., "Modification of a scanning electron microscope to produce Smith—Purcell radiation", Rev. Sci. Instrum. 75, 4732 (2004).
Scherer et al. "Photonic Crystals for Confining, Guiding, and Emitting Light", IEEE Transactions on Nanotechnology, vol. 1, No. 1, Mar. 2002, pp. 4-11.
U.S. Appl. No. 11/203,407—Jul. 17, 2009 PTO Office Action.
U.S. Appl. No. 11/418,097—Sep. 16, 2009 PTO Office Action.
U.S. Appl. No. 11/418,123—Aug. 11, 2009 PTO Office Action.
U.S. Appl. No. 11/418,365—Jul. 23, 2009 PTO Office Action.
U.S. Appl. No. 11/441,240—Aug. 31, 2009 PTO Office Action.
Urata et al., "Superradiant Smith-Purcell Emission", Phys. Rev. Lett. 80, 516-519 (1998).
"Array of Nanoklystrons for Frequency Agility or Redundancy," NASA's Jet Propulsion Laboratory, NASA Tech Briefs, NPO-21033. 2001.
"Antenna Arrays." May 18, 2002. www.tpub.com/content/neets/14183/css/14183_159.htm.
Alford, T.L. et al., "Advanced silver-based metallization patterning for ULSI applications," Microelectronic Engineering 55, 2001, pp. 383-388, Elsevier Science B.V.
Amato, Ivan, "An Everyman's Free-Electron Laser?" Science, New Series, Oct. 16, 1992, p. 401, vol. 258 No. 5081, American Association for the Advancement of Science.
Andrews, H.L. et al., "Dispersion and Attenuation in a Smith-Purcell Free Electron Laser," The American Physical Society, Physical Review Special Topics—Accelerators and Beams 8 (2005), pp. 050703-1-050703-9.
Bakhtyari, A. et al., "Horn Resonator Boosts Miniature Free-Electron Laser Power," Applied Physics Letters, May 12, 2003, pp. 3150-3152, vol. 82, No. 19, American Institute of Physics.
Bhattacharjee, Sudeep et al., "Folded Waveguide Traveling-Wave Tube Sources for Terahertz Radiation." IEEE Transactions on Plasma Science, vol. 32. No. 3, Jun. 2004, pp. 1002-1014.
Brau, C.A. et al., "Gain and Coherent Radiation from a Smith-Purcell Free Electron Laser," Proceedings of the 2004 FEL Conference, pp. 278-281.
Brownell, J.H. et al., "Improved μFEL Performance with Novel Resonator," Jan. 7, 2005, from website: www.frascati.enea.it/thz-bridge/workshop/presentations/Wednesday/We-07-Brownell.ppt.
Brownell, J.H. et al., "The Angular Distribution of the Power Produced by Smith-Purcell Radiation," J. Phys. D: Appl. Phys. 1997, pp. 2478-2481, vol. 30, IOP Publishing Ltd., United Kingdom.
Chuang, S.L. et al., "Enhancement of Smith-Purcell Radiation from a Grating with Surface-Plasmon Excitation," Journal of the Optical Society of America, Jun. 1984, pp. 672-676, vol. 1 No. 6, Optical Society of America.
Chuang, S.L. et al., "Smith-Purcell Radiation from a Charge Moving Above a Penetrable Grating," IEEE MTT-S Digest, 1983, pp. 405-406, IEEE.
Far-IR, Sub-MM & MM Detector Technology Workshop list of manuscripts, session 6 2002.
Feltz, W.F. et al., "Near-Continuous Profiling of Temperature, Moisture, and Atmospheric Stability Using the Atmospheric Emitted Radiance Interferometer (AERI)," Journal of Applied Meteorology, May 2003, vol. 42 No. 5, H.W. Wilson Company, pp. 584-597.
Freund, H.P. et al., "Linearized Field Theory of a Smith-Purcell Traveling Wave Tube," IEEE Transactions on Plasma Science, Jun. 2004, pp. 1015-1027, vol. 32 No. 3, IEEE.
Kapp, Oscar H. et al., "Modification of a Scanning Electron Microscope to Produce Smith-Purcell Radiation," Review of Scientific Instruments, Nov. 2004, pp. 4732-4741, vol. 75 No. 11, American Institute of Physics.
Kiener, C. et al., "Investigation of the Mean Free Path of Hot Electrons in GaAs/AlGaAs Heterostructures," Semicond. Sci. Technol., 1994, pp. 193-197, vol. 9, IOP Publishing Ltd., United Kingdom.
Kim, Shang Hoon, "Quantum Mechanical Theory of Free-Electron Two-Quantum Stark Emission Driven by Transverse Motion," Journal of the Physical Society of Japan, Aug. 1993, vol. 62 No. 8, pp. 2528-2532.
Kube, G. et al., "Observation of Optical Smith-Purcell Radiation at an Electron Beam Energy of 855 MeV," Physical Review E, May 8, 2003, vol. 65, The American Physical Society, pp. 056501-1-056501-15.
Liu, Chuan Sheng, et al., "Stimulated Coherent Smith-Purcell Radiation from a Metallic Grating," IEEE Journal of Quantum Electronics, Oct. 1999, pp. 1386-1389, vol. 35, No. 10, IEEE.
Manohara, Harish et al., "Field Emission Testing of Carbon Nanotubes for THz Frequency Vacuum Microtube Sources." Abstract. Dec. 2003. from SPIEWeb.
McDaniel, James C. et al., "Smith-Purcell Radiation in the High Conductivity and Plasma Frequency Limits," Applied Optics, Nov. 15, 1989, pp. 4924-4929, vol. 28 No. 22, Optical Society of America.
Meyer, Stephan, "Far IR, Sub-MM & MM Detector Technology Workshop Summary," Oct. 2002. (may date the Manohara documents).
Nguyen, Phucanh et al., "Novel technique to pattern silver using CF4 and CF4/O2 glow discharges," J.Vac. Sci. Technol. B 19(1), Jan./Feb. 2001, American Vacuum Society, pp. 158-165.
Nguyen, Phucanh et al., "Reactive ion etch of patterned and blanket silver thin films in Cl2/O2 and O2 glow discharges," J. Vac. Sci, Technol. B. 17 (5), Sep./Oct. 1999, American Vacuum Society, pp. 2204-2209.
Phototonics Research, "Surface-Plasmon-Enhanced Random Laser Demonstrated," Phototonics Spectra, Feb. 2005, pp. 112-113.
Potylitsin, A.P., "Resonant Diffraction Radiation and Smith-Purcell Effect," (Abstract), arXiv: physics/9803043 v2 Apr. 13, 1998.

Potylitsyn, A.P., "Resonant Diffraction Radiation and Smith-Purcell Effect," Physics Letters A, Feb. 2, 1998, pp. 112-116, A 238, Elsevier Science B.V.
Savilov, Andrey V., "Stimulated Wave Scattering in the Smith-Purcell FEL," IEEE Transactions on Plasma Science, Oct. 2001, pp. 820-823, vol. 29 No. 5, IEEE.
Search Report and Written Opinion mailed Mar. 7, 2007 in corresponding PCT Appln. No. PCT/US2006/022775.
Thurn-Albrecht et al., "Ultrahigh-Density Nanowire Arrays Grown in Self-Assembled Diblock Copolymer Templates", Science 290. 5499, Dec. 15, 2000, pp. 2126-2129.
"Making E-rays," http://www.fnrfscience.cmu.ac.th/theory/radiation/xray-basics.html, printed on Dec. 29, 2008.
"Microwave Tubes," http://www.tpub.com/neets/book11/45b.htm, printed on Dec. 26, 2008.
"The Reflex Klystron," http://www.fnrfscience.cmu.ac.th/theory/microwave/microwave%2, printed from Fast Netoron Research Facilty on Dec. 26, 2008.
"X-ray tube," http://www.answers.com/topic/x-ray-tube, printed on Dec. 29, 2008.
U.S. Appl. No. 11/641,678—Jan. 22, 2009 Response to Office Action of Jul. 22, 2008.
U.S. Appl. No. 11/711,000—Mar. 6, 2009 PTO Office Action.
U.S. Appl. No. 11/716,552—Feb. 12, 2009 Response to PTO Office Action of Feb. 9, 2009.
U.S. Appl. No. 11/716,552—Jul. 3, 2008 PTO Office Action.
Whiteside, Andy et al., "Dramatic Power Savings using Depressed Collector IOT Transmitters in Digital and Analog Service."
Kaplan et al.: "Extreme-Ultraviolet and X-ray Emission and Amplification by Nonrelativistic Electron Beams Traversing a Superlattice" Applied Physics Letters, AIP, American Institute of Physics, Melville, NY LNKD- DOI: 10.1063/1.94869, vol. 44, No. 7, Apr. 1, 1984, pp. 661-663, XP000706537 ISSN: 0003-6951.
Supplementary European Search Report mailed Jul. 2, 2010 in EP Appln. No. 06772832.9.
Supplementary European Search Report mailed Jul. 5, 2010 in EP Appln. No. 06772830.3.
U.S. Appl. No. 11/418,318, filed Jun. 11, 2010 PTO Office Action.

* cited by examiner

ULTRA-SMALL RESONATING CHARGED PARTICLE BEAM MODULATOR

RELATED APPLICATIONS

This application is related to U.S. patent application Ser. No. 10/917,511, filed on Aug. 13, 2004, entitled "Patterning Thin Metal Film by Dry Reactive Ion Etching," and U.S. application Ser. No. 11/203,407, filed on Aug. 15, 2005, entitled "Method Of Patterning Ultra-Small Structures," filed on Aug. 15, 2005, both of which are commonly owned with the present application at the time of filing, and the entire contents of each of which are incorporated herein by reference.

COPYRIGHT NOTICE

A portion of the disclosure of this patent document contains material which is subject to copyright or mask work protection. The copyright or mask work owner has no objection to the facsimile reproduction by anyone of the patent document or the patent disclosure, as it appears in the Patent and Trademark Office patent file or records, but otherwise reserves all copyright or mask work rights whatsoever.

FIELD OF INVENTION

This disclosure relates to the modulation of a beam of charged particles.

INTRODUCTION AND BACKGROUND

Electromagnetic Radiation & Waves

Electromagnetic radiation is produced by the motion of electrically charged particles. Oscillating electrons produce electromagnetic radiation commensurate in frequency with the frequency of the oscillations. Electromagnetic radiation is essentially energy transmitted through space or through a material medium in the form of electromagnetic waves. The term can also refer to the emission and propagation of such energy. Whenever an electric charge oscillates or is accelerated, a disturbance characterized by the existence of electric and magnetic fields propagates outward from it. This disturbance is called an electromagnetic wave. Electromagnetic radiation falls into categories of wave types depending upon their frequency, and the frequency range of such waves is tremendous, as is shown by the electromagnetic spectrum in the following chart (which categorizes waves into types depending upon their frequency):

| Type | Approx. Frequency |
|---|---|
| Radio | Less than 3 Gigahertz |
| Microwave | 3 Gigahertz-300 Gigahertz |
| Infrared | 300 Gigahertz-400 Terahertz |
| Visible | 400 Terahertz-750 Terahertz |
| UV | 750 Terahertz-30 Petahertz |
| X-ray | 30 Petahertz-30 Exahertz |
| Gamma-ray | Greater than 30 Exahertz |

The ability to generate (or detect) electromagnetic radiation of a particular type (e.g., radio, microwave, etc.) depends upon the ability to create a structure suitable for electron oscillation or excitation at the frequency desired. Electromagnetic radiation at radio frequencies, for example, is relatively easy to generate using relatively large or even somewhat small structures.

Electromagnetic Wave Generation

There are many traditional ways to produce high-frequency radiation in ranges at and above the visible spectrum, for example, up to high hundreds of Terahertz. There are also many traditional and anticipated applications that use such high frequency radiation. As frequencies increase, however, the kinds of structures needed to create the electromagnetic radiation at a desired frequency become generally smaller and harder to manufacture. We have discovered ultra-small-scale devices that obtain multiple different frequencies of radiation from the same operative layer.

Resonant structures have been the basis for much of the presently known high frequency electronics. Devices like klystrons and magnetrons had electronics that moved frequencies of emission up to the megahertz range by the 1930s and 1940s. By around 1960, people were trying to reduce the size of resonant structures to get even higher frequencies, but had limited success because the Q of the devices went down due to the resistivity of the walls of the resonant structures. At about the same time, Smith and Purcell saw the first signs that free electrons could cause the emission of electromagnetic radiation in the visible range by running an electron beam past a diffraction grating. Since then, there has been much speculation as to what the physical basis for the Smith-Purcell radiation really is.

We have shown that some of the theory of resonant structures applies to certain nano structures that we have built. It is assumed that at high enough frequencies, plasmons conduct the energy as opposed to the bulk transport of electrons in the material, although our inventions are not dependent upon such an explanation. Under that theory, the electrical resistance decreases to the point where resonance can effectively occur again, and makes the devices efficient enough to be commercially viable.

Some of the more detailed background sections that follow provide background for the earlier technologies (some of which are introduced above), and provide a framework for understanding why the present inventions are so remarkable compared to the present state-of-the-art.

Microwaves

As previously introduced, microwaves were first generated in so-called "klystrons" in the 1930s by the Varian brothers. Klystrons are now well-known structures for oscillating electrons and creating electromagnetic radiation in the microwave frequency. The structure and operation of klystrons has been well-studied and documented and will be readily understood by the artisan. However, for the purpose of background, the operation of the klystron will be described at a high level, leaving the particularities of such devices to the artisan's present understanding.

Klystrons are a type of linear beam microwave tube. A basic structure of a klystron is shown by way of example in FIG. 1(*a*). In the late 1930s, a klystron structure was described that involved a direct current stream of electrons within a vacuum cavity passing through an oscillating electric field. In the example of FIG. 1(*a*), a klystron 100 is shown as a high-vacuum device with a cathode 102 that emits a well-focused electron beam 104 past a number of cavities 106 that the beam traverses as it travels down a linear tube 108 to anode 103. The cavities are sized and designed to resonate at or near the operating frequency of the tube. The principle, in essence, involves conversion of the kinetic energy in the beam, imparted by a high accelerating voltage, to microwave energy. That conversion takes place as a result of the amplified RF (radio frequency) input signal causing the electrons in the beam to "bunch up" into so-called "bunches" (denoted 110) along the beam path as they pass the various cavities 106. These bunches then give up their energy to the high-level induced RF fields at the output cavity.

The electron bunches are formed when an oscillating electric field causes the electron stream to be velocity modulated so that some number of electrons increase in speed within the stream and some number of electrons decrease in speed within the stream. As the electrons travel through the drift tube of the vacuum cavity the bunches that are formed create a space-charge wave or charge-modulated electron beam. As the electron bunches pass the mouth of the output cavity, the bunches induce a large current, much larger than the input current. The induced current can then generate electromagnetic radiation.

Traveling Wave Tubes

Traveling wave tubes (TWT)—first described in 1942—are another well-known type of linear microwave tube. A TWT includes a source of electrons that travels the length of a microwave electronic tube, an attenuator, a helix delay line, radio frequency (RF) input and output, and an electron collector. In the TWT, an electrical current was sent along the helical delay line to interact with the electron stream.

Backwards Wave Devices

Backwards wave devices are also known and differ from TWTs in that they use a wave in which the power flow is opposite in direction from that of the electron beam. A backwards wave device uses the concept of a backward group velocity with a forward phase velocity. In this case, the RF power comes out at the cathode end of the device. Backward wave devices could be amplifiers or oscillators.

Magnetrons

Magnetrons are another type of well-known resonance cavity structure developed in the 1920s to produce microwave radiation. While their external configurations can differ, each magnetron includes an anode, a cathode, a particular wave tube and a strong magnet. FIG. 1(*b*) shows an exemplary magnetron 112. In the example magnetron 112 of FIG. 1(*b*), the anode is shown as the (typically iron) external structure of the circular wave tube 114 and is interrupted by a number of cavities 116 interspersed around the tube 114. The cathode 118 is in the center of the magnetron, as shown. Absent a magnetic field, the cathode would send electrons directly outward toward the anode portions forming the tube 114. With a magnetic field present and in parallel to the cathode, electrons emitted from the cathode take a circular path 118 around the tube as they emerge from the cathode and move toward the anode. The magnetic field from the magnet (not shown) is thus used to cause the electrons of the electron beam to spiral around the cathode, passing the various cavities 116 as they travel around the tube. As with the linear klystron, if the cavities are tuned correctly, they cause the electrons to bunch as they pass by. The bunching and unbunching electrons set up a resonant oscillation within the tube and transfer their oscillating energy to an output cavity at a microwave frequency.

Reflex Klystron

Multiple cavities are not necessarily required to produce microwave radiation. In the reflex klystron, a single cavity, through which the electron beam is passed, can produce the required microwave frequency oscillations. An example reflex klystron 120 is shown in FIG. 1(*c*). There, the cathode 122 emits electrons toward the reflector plate 124 via an accelerator grid 126 and grids 128. The reflex klystron 120 has a single cavity 130. In this device, the electron beam is modulated (as in other klystrons) by passing by the cavity 130 on its way away from the cathode 122 to the plate 124. Unlike other klystrons, however, the electron beam is not terminated at an output cavity, but instead is reflected by the reflector plate 124. The reflection provides the feedback necessary to maintain electron oscillations within the tube.

In each of the resonant cavity devices described above, the characteristic frequency of electron oscillation depends upon the size, structure, and tuning of the resonant cavities. To date, structures have been discovered that create relatively low frequency radiation (radio and microwave levels), up to, for example, GHz levels, using these resonant structures. Higher levels of radiation are generally thought to be prohibitive because resistance in the cavity walls will dominate with smaller sizes and will not allow oscillation. Also, using current techniques, aluminum and other metals cannot be machined down to sufficiently small sizes to form the cavities desired. Thus, for example, visible light radiation in the range of 400 Terahertz-750 Terahertz is not known to be created by klystron-type structures.

U.S. Pat. No. 6,373,194 to Small illustrates the difficulty in obtaining small, high-frequency radiation sources. Small suggests a method of fabricating a micro-magnetron. In a magnetron, the bunched electron beam passes the opening of the resonance cavity. But to realize an amplified signal, the bunches of electrons must pass the opening of the resonance cavity in less time than the desired output frequency. Thus at a frequency of around 500 THz, the electrons must travel at very high speed and still remain confined. There is no practical magnetic field strong enough to keep the electron spinning in that small of a diameter at those speeds. Small recognizes this issue but does not disclose a solution to it.

Surface plasmons can be excited at a metal dielectric interface by a monochromatic light beam. The energy of the light is bound to the surface and propagates as an electromagnetic wave. Surface plasmons can propagate on the surface of a metal as well as on the interface between a metal and dielectric material. Bulk plasmons can propagate beneath the surface, although they are typically not energetically favored.

Free electron lasers offer intense beams of any wavelength because the electrons are free of any atomic structure. In U.S. Pat. No. 4,740,973, Madey et al. disclose a free electron laser. The free electron laser includes a charged particle accelerator, a cavity with a straight section and an undulator. The accelerator injects a relativistic electron or positron beam into said straight section past an undulator mounted coaxially along said straight section. The undulator periodically modulates in space the acceleration of the electrons passing through it inducing the electrons to produce a light beam that is practically collinear with the axis of undulator. An optical cavity is defined by two mirrors mounted facing each other on either side of the undulator to permit the circulation of light thus emitted. Laser amplification occurs when the period of said circulation of light coincides with the period of passage of the electron packets and the optical gain per passage exceeds the light losses that occur in the optical cavity.

Smith-Purcell

Smith-Purcell radiation occurs when a charged particle passes close to a periodically varying metallic surface, as depicted in FIG. 1(*d*).

Known Smith-Purcell devices produce visible light by passing an electron beam close to the surface of a diffraction grating. Using the Smith-Purcell diffraction grating, electrons are deflected by image charges in the grating at a frequency in the visible spectrum. In some cases, the effect may be a single electron event, but some devices can exhibit a change in slope of the output intensity versus current. In Smith-Purcell devices, only the energy of the electron beam and the period of the grating affect the frequency of the visible light emission. The beam current is generally, but not always, small. Vermont Photonics notice an increase in output with their devices above a certain current density limit. Because of the nature of diffraction physics, the period of the grating must exceed the wavelength of light.

Koops, et al., U.S. Pat. No. 6,909,104, published Nov. 30, 2000, (§102(e) date May 24, 2002) describe a miniaturized coherent terahertz free electron laser using a periodic grating for the undulator (sometimes referred to as the wiggler). Koops et al. describe a free electron laser using a periodic structure grating for the undulator (also referred to as the wiggler). Koops proposes using standard electronics to bunch the electrons before they enter the undulator. The apparent object of this is to create coherent terahertz radiation. In one instance, Koops, et al. describe a given standard electron beam source that produces up to approximately 20,000 volts accelerating voltage and an electron beam of 20 microns diameter over a grating of 100 to 300 microns period to achieve infrared radiation between 100 and 1000 microns in wavelength. For terahertz radiation, the diffraction grating has a length of approximately 1 mm to 1 cm, with grating periods of 0.5 to 10 microns, "depending on the wavelength of the terahertz radiation to be emitted." Koops proposes using standard electronics to bunch the electrons before they enter the undulator.

Potylitsin, "Resonant Diffraction Radiation and Smith-Purcell Effect," 13 Apr. 1998, described an emission of electrons moving close to a periodic structure treated as the resonant diffraction radiation. Potylitsin's grating had "perfectly conducting strips spaced by a vacuum gap."

Smith-Purcell devices are inefficient. Their production of light is weak compared to their input power, and they cannot be optimized. Current Smith-Purcell devices are not suitable for true visible light applications due at least in part to their inefficiency and inability to effectively produce sufficient photon density to be detectible without specialized equipment.

We realized that the Smith-Purcell devices yielded poor light production efficiency. Rather than deflect the passing electron beam as Smith-Purcell devices do, we created devices that resonated at the frequency of light as the electron beam passes by. In this way, the device resonance matches the system resonance with resulting higher output. Our discovery has proven to produce visible light (or even higher or lower frequency radiation) at higher yields from optimized ultra-small physical structures.

Coupling Energy from Electromagnetic Waves

Coupling energy from electromagnetic waves in the terahertz range from 0.1 THz (about 3000 microns) to 700 THz (about 0.4 microns) is finding use in numerous new applications. These applications include improved detection of concealed weapons and explosives, improved medical imaging, finding biological materials, better characterization of semiconductors; and broadening the available bandwidth for wireless communications.

In solid materials the interaction between an electromagnetic wave and a charged particle, namely an electron, can occur via three basic processes: absorption, spontaneous emission and stimulated emission. The interaction can provide a transfer of energy between the electromagnetic wave and the electron. For example, photoconductor semiconductor devices use the absorption process to receive the electromagnetic wave and transfer energy to electron-hole pairs by band-to-band transitions. Electromagnetic waves having an energy level greater than a material's characteristic binding energy can create electrons that move when connected across a voltage source to provide a current. In addition, extrinsic photoconductor devices operate having transitions across forbidden-gap energy levels use the absorption process (S. M., Sze, "Semiconductor Devices Physics and Technology," 2002).

A measure of the energy coupled from an electromagnetic wave for the material is referred to as an absorption coefficient. A point where the absorption coefficient decreases rapidly is called a cutoff wavelength. The absorption coefficient is dependant on the particular material used to make a device. For example, gallium arsenide (GaAs) absorbs electromagnetic wave energy from about 0.6 microns and has a cutoff wavelength of about 0.87 microns. In another example, silicon (Si) can absorb energy from about 0.4 microns and has a cutoff wavelength of about 1.1 microns. Thus, the ability to transfer energy to the electrons within the material for making the device is a function of the wavelength or frequency of the electromagnetic wave. This means the device can work to couple the electromagnetic wave's energy only over a particular segment of the terahertz range. At the very high end of the terahertz spectrum a Charge Coupled Device (CCD)—an intrinsic photoconductor device—can successfully be employed. If there is a need to couple energy at the lower end of the terahertz spectrum certain extrinsic semiconductors devices can provide for coupling energy at increasing wavelengths by increasing the doping levels.

Surface Enhanced Raman Spectroscopy (SERS)

Raman spectroscopy is a well-known means to measure the characteristics of molecule vibrations using laser radiation as the excitation source. A molecule to be analyzed is illuminated with laser radiation and the resulting scattered frequencies are collected in a detector and analyzed.

Analysis of the scattered frequencies permits the chemical nature of the molecules to be explored. Fleischmann et al. (M. Fleischmann, P. J. Hendra and A. J. McQuillan, Chem. Phys. Lett., 1974, 26, 163) first reported the increased scattering intensities that result from Surface Enhanced Raman Spectroscopy (SERS), though without realizing the cause of the increased intensity.

In SERS, laser radiation is used to excite molecules adsorbed or deposited onto a roughened or porous metallic surface, or a surface having metallic nano-sized features or structures. The largest increase in scattering intensity is realized with surfaces with features that are 10-100 nm in size. Research into the mechanisms of SERS over the past 25 years suggests that both chemical and electromagnetic factors contribute to the enhancing the Raman effect. (See, e.g., A. Campion and P. Kambhampati, Chem. Soc. Rev., 1998, 27 241.)

The electromagnetic contribution occurs when the laser radiation excites plasmon resonances in the metallic surface structures. These plasmons induce local fields of electromagnetic radiation which extend and decay at the rate defined by the dipole decay rate. These local fields contribute to enhancement of the Raman scattering at an overall rate of E4.

Recent research has shown that changes in the shape and composition of nano-sized features of the substrate cause variation in the intensity and shape of the local fields created by the plasmons. Jackson and Halas (J. B. Jackson and N. J. Halas, PNAS, 2004, 101 17930) used nano-shells of gold to tune the plasmon resonance to different frequencies.

Variation in the local electric field strength provided by the induced plasmon is known in SERS-based devices. In U.S. Patent application 2004/0174521 A1, Drachev et al. describe a Raman imaging and sensing device employing nanoantennas. The antennas are metal structures deposited onto a surface. The structures are illuminated with laser radiation. The radiation excites a plasmon in the antennas that enhances the Raman scatter of the sample molecule.

The electric field intensity surrounding the antennas varies as a function of distance from the antennas, as well as the size of the antennas. The intensity of the local electric field increases as the distance between the antennas decreases.

Advantages & Benefits

Myriad benefits and advantages can be obtained by a ultra-small resonant structure that emits varying electromagnetic radiation at higher radiation frequencies such as infrared, visible, UV and X-ray. For example, if the varying electromagnetic radiation is in a visible light frequency, the micro resonant structure can be used for visible light applications that currently employ prior art semiconductor light emitters (such as LCDs, LEDs, and the like that employ electroluminescence or other light-emitting principals). If small enough, such micro-resonance structures can rival semiconductor devices in size, and provide more intense, variable, and efficient light sources. Such micro resonant structures can also be used in place of (or in some cases, in addition to) any application employing non-semiconductor illuminators (such as incandescent, fluorescent, or other light sources). Those applications can include displays for personal or commercial use, home or business illumination, illumination for private display such as on computers, televisions or other screens, and for public display such as on signs, street lights, or other indoor or outdoor illumination. Visible frequency radiation from ultra-small resonant structures also has application in fiber optic communication, chip-to-chip signal coupling, other electronic signal coupling, and any other light-using applications.

Applications can also be envisioned for ultra-small resonant structures that emit in frequencies other than in the visible spectrum, such as for high frequency data carriers. Ultra-small resonant structures that emit at frequencies such as a few tens of terahertz can penetrate walls, making them invisible to a transceiver, which is exceedingly valuable for security applications. The ability to penetrate walls can also be used for imaging objects beyond the walls, which is also useful in, for example, security applications. X-ray frequencies can also be produced for use in medicine, diagnostics, security, construction or any other application where X-ray sources are currently used. Terahertz radiation from ultra-small resonant structures can be used in many of the known applications which now utilize x-rays, with the added advantage that the resulting radiation can be coherent and is non-ionizing.

The use of radiation per se in each of the above applications is not new. But, obtaining that radiation from particular kinds of increasingly small ultra-small resonant structures revolutionizes the way electromagnetic radiation is used in electronic and other devices. For example, the smaller the radiation emitting structure is, the less "real estate" is required to employ it in a commercial device. Since such real estate on a semiconductor, for example, is expensive, an ultra-small resonant structure that provides the myriad application benefits of radiation emission without consuming excessive real estate is valuable. Second, with the kinds of ultra-small resonant structures that we describe, the frequency of the radiation can be high enough to produce visible light of any color and low enough to extend into the terahertz levels (and conceivably even petahertz or exahertz levels with additional advances). Thus, the devices may be tunable to obtain any kind of white light transmission or any frequency or combination of frequencies desired without changing or stacking "bulbs," or other radiation emitters (visible or invisible).

Currently, LEDs and Solid State Lasers (SSLs) cannot be integrated onto silicon (although much effort has been spent trying). Further, even when LEDs and SSLs are mounted on a wafer, they produce only electromagnetic radiation at a single color. The present devices are easily integrated onto even an existing silicon microchip and can produce many frequencies of electromagnetic radiation at the same time.

A new structure for producing electromagnetic radiation is now described in which a source produces a beam of charged particles that is modulated by interaction with a varying electric field induced by a ultra-small resonant structure.

GLOSSARY

As used throughout this document:

The phrase "ultra-small resonant structure" shall mean any structure of any material, type or microscopic size that by its characteristics causes electrons to resonate at a frequency in excess of the microwave frequency.

The term "ultra-small" within the phrase "ultra-small resonant structure" shall mean microscopic structural dimensions and shall include so-called "micro" structures, "nano" structures, or any other very small structures that will produce resonance at frequencies in excess of microwave frequencies.

DESCRIPTION OF PRESENTLY PREFERRED EXEMPLARY EMBODIMENTS OF THE INVENTION

Brief Description of Figures

The invention is better understood by reading the following detailed description with reference to the accompanying drawings in which:

FIG. 1(*b*) shows a prior art example magnetron.

FIG. 1(*c*) shows a prior art example reflex klystron.

FIG. 1(*d*) depicts aspects of the Smith-Purcell theory.

DESCRIPTION

Figure 1A:
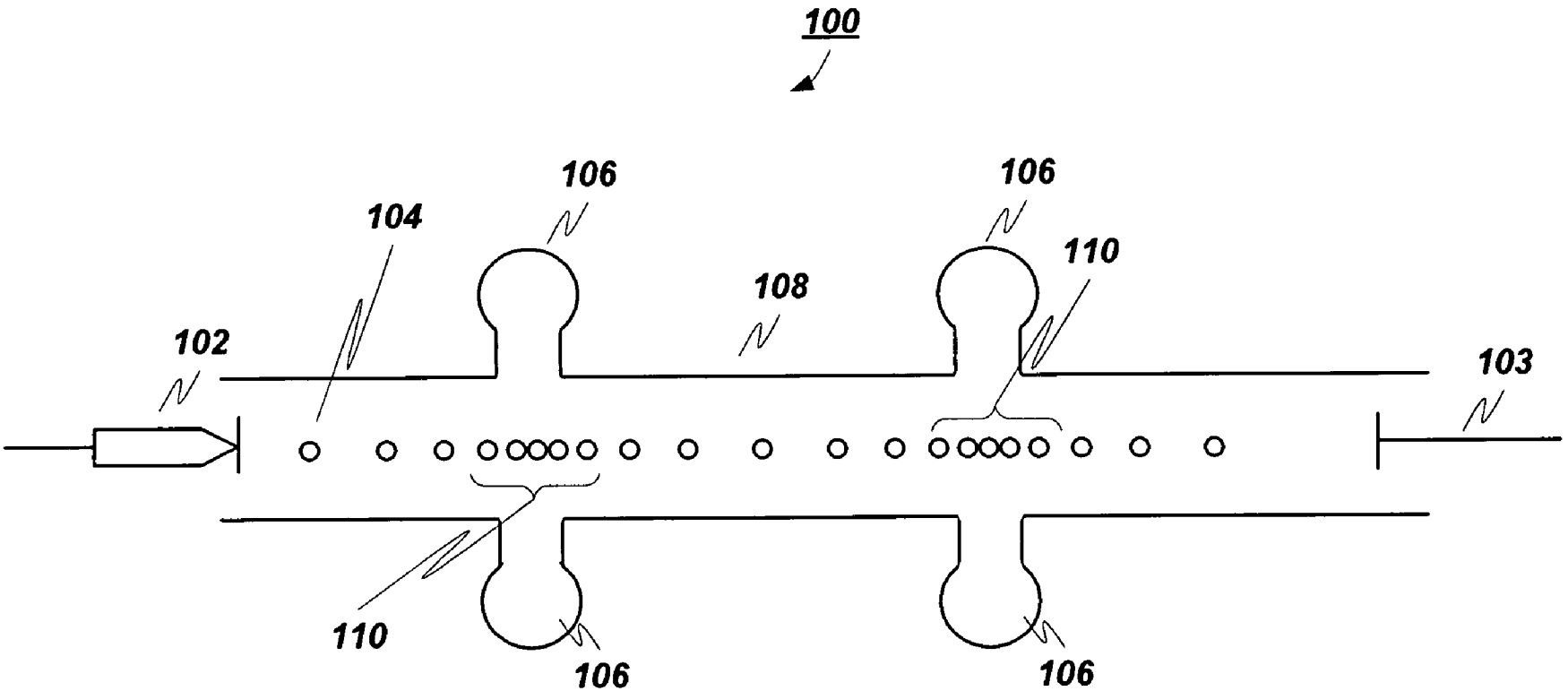
Fig. 1(a) (Prior Art)
FIG. 1(*a*) shows a prior art example klystron.
Figure 1B:
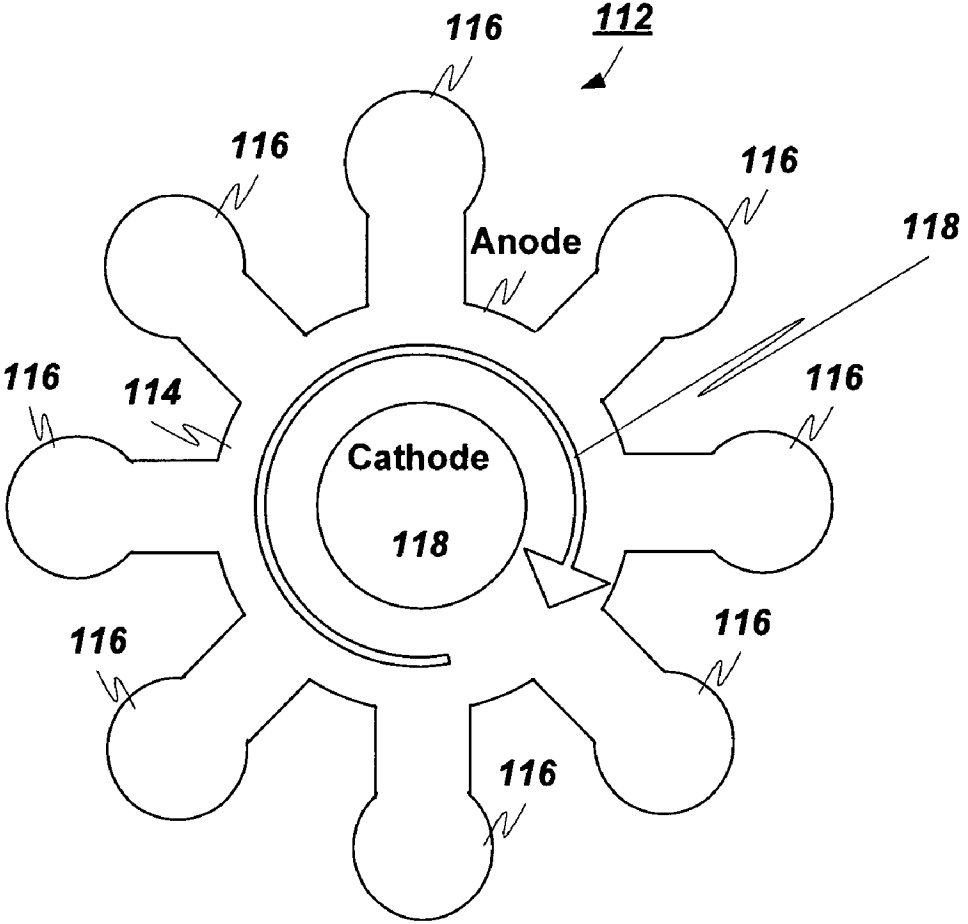
Fig. 1(b) (Prior Art)
Figure 1C:
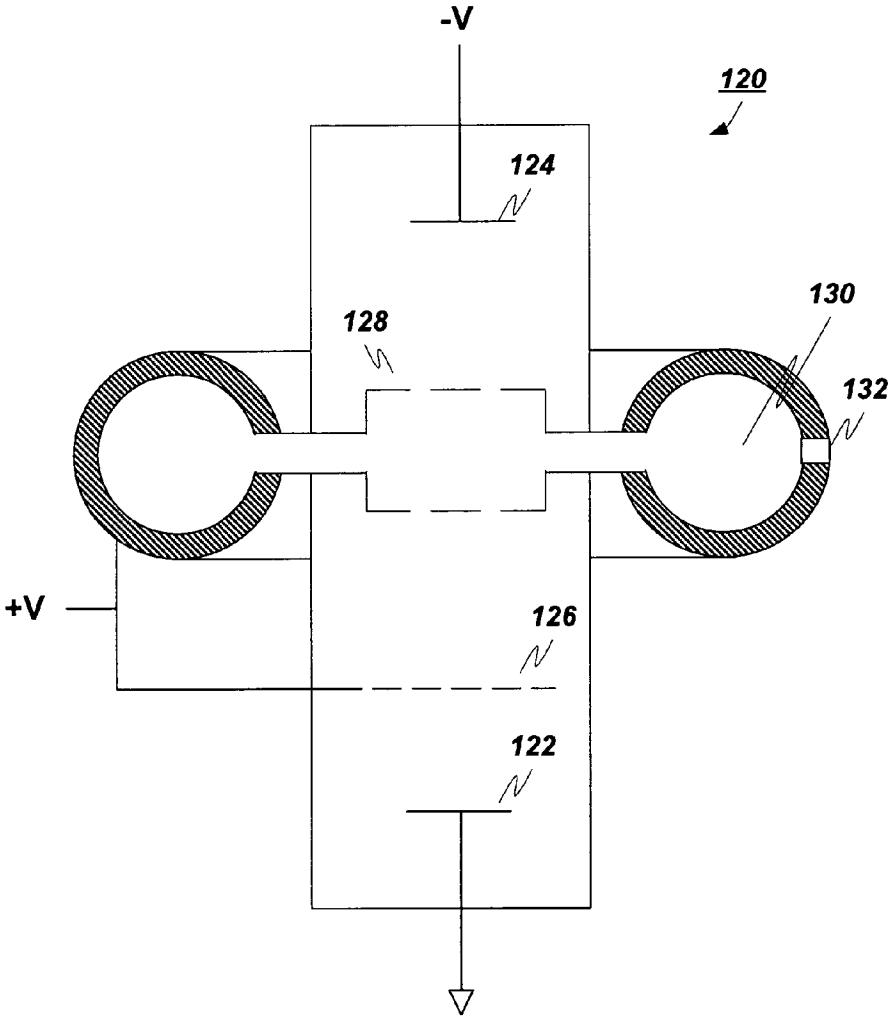
Fig. 1(c) (Prior Art)
Figure 1D:
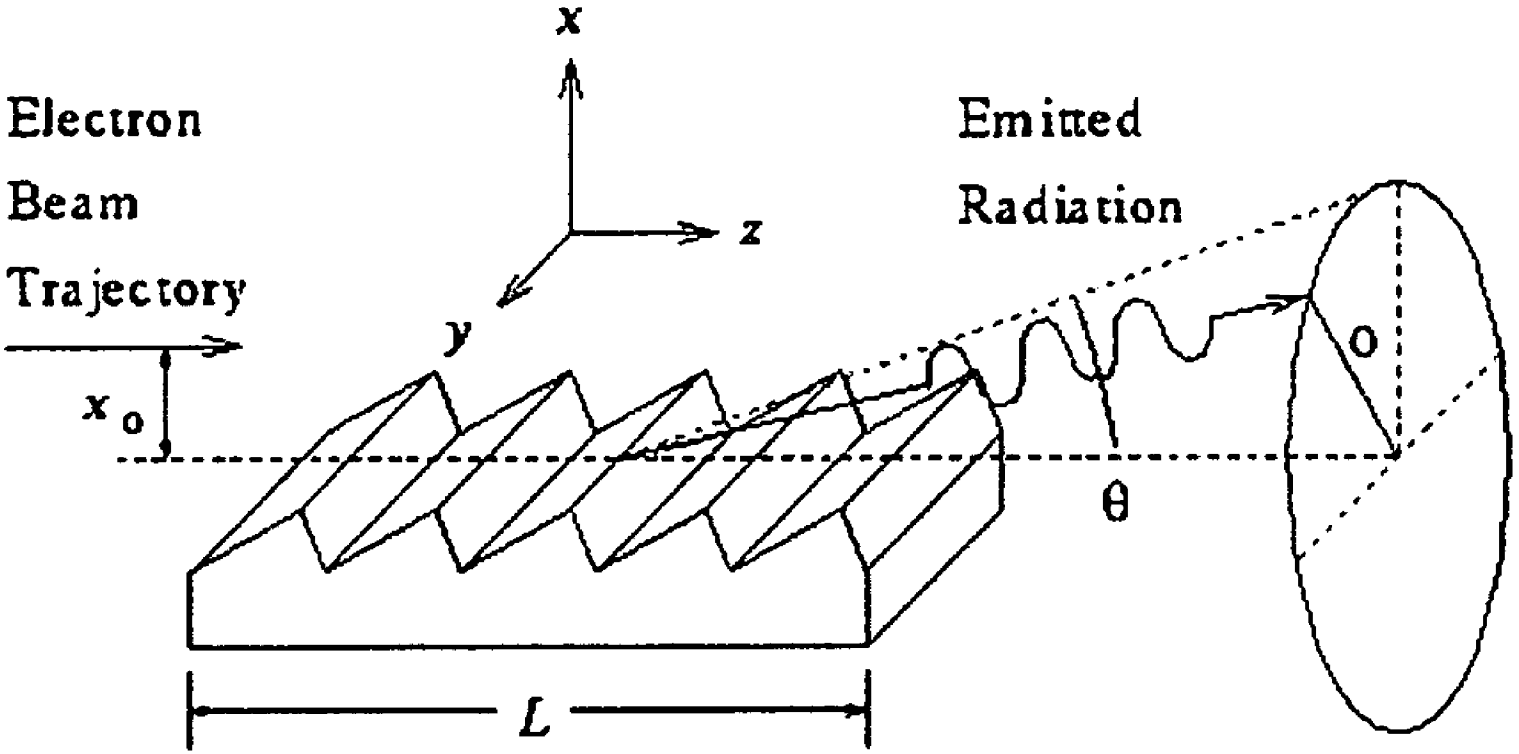
Fig. 1(d) (Prior Art)
Figure 2:
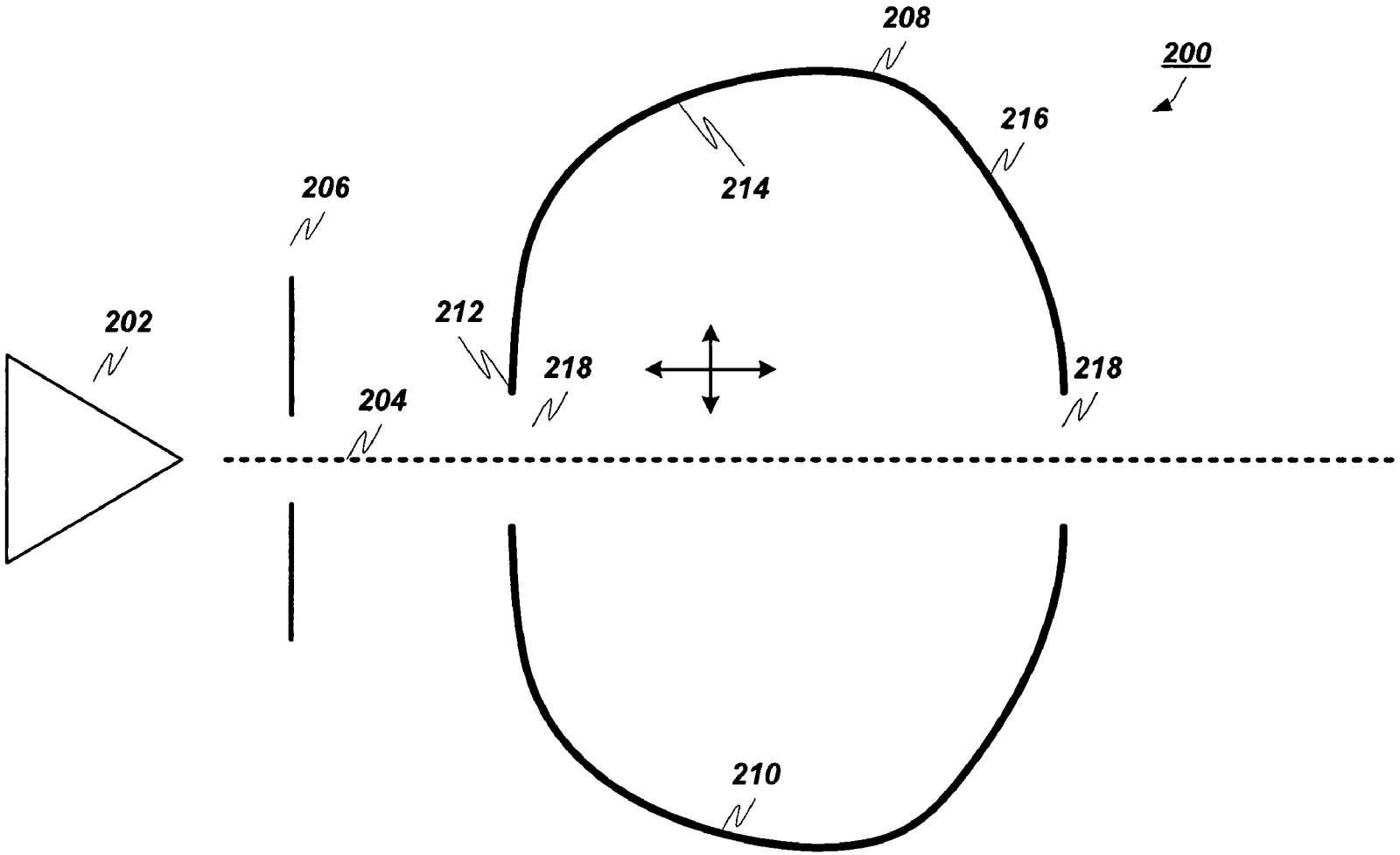
FIG. 2 is a schematic of a charged particle modulator that velocity modulates a beam of charged particles according to embodiments of the present invention.

FIG. 2 depicts a charged particle modulator 200 that velocity modulates a beam of charged particles according to embodiments of the present invention. As shown in FIG. 2, a source of charged particles 202 is shown producing a beam 204 consisting of one or more charged particles. The charged particles can be electrons, protons or ions and can be produced by any source of charged particles including cathodes, tungsten filaments, planar vacuum triodes, ion guns, electron-impact ionizers, laser ionizers, chemical ionizers, thermal ionizers, or ion impact ionizers. The artisan will recognize that many well-known means and methods exist to provide a suitable source of charged particles beyond the means and methods listed.

Beam 204 accelerates as it passes through bias structure 206. The source of charged particles 202 and accretion bias structure 206 are connected across a voltage. Beam 204 then traverses excited ultra-small resonant structures 208 and 210.

An example of an accretion bias structure is an anode, but the artisan will recognize that other means exist for creating an accretion bias structure for a beam of charged particles.

Ultra-small resonant structures 208 and 210 represent a simple form of ultra-small resonant structure fabrication in a planar device structure. Other more complex structures are also envisioned but for purposes of illustration of the principles involved the simple structure of FIG. 2 is described. There is no requirement that ultra-small resonant structures 208 and 210 have a simple or set shape or form. Ultra-small resonant structures 208 and 210 encompass a semi-circular shaped cavity having wall 212 with inside surface 214, outside surface 216 and opening 218. The artisan will recognize that there is no requirement that the cavity have a semi-circular shape but that the shape can be any other type of suitable arrangement.

Ultra-small resonant structures 208 and 210 may have identical shapes and symmetry, but there is no requirement that they be identical or symmetrical in shape or size. There is no requirement that ultra-small resonant structures 208 and 210 be positioned with any symmetry relating to the other. An exemplary embodiment can include two ultra-small resonant structures; however there is no requirement that there be more than one ultra-small resonant structure nor less than any number of ultra-small resonant structures. The number, size and symmetry are design choices once the inventions are understood.

In one exemplary embodiment, wall 212 is thin with an inside surface 214 and outside surface 216. There is, however, no requirement that the wall 212 have some minimal thickness. In alternative embodiments, wall 212 can be thick or thin. Wall 212 can also be single sided or have multiple sides.

In some exemplary embodiments, ultra-small resonant structure 208 encompasses a cavity circumscribing a vacuum environment. There is, however, no requirement that ultra-small resonant structure 208 encompass a cavity circumscribing a vacuum environment. Ultra-small resonant structure 208 can confine a cavity accommodating other environments, including dielectric environments.

In some exemplary embodiments, a current is excited within ultra-small resonant structures 208 and 210. When ultra-small resonant structure 208 becomes excited, a current oscillates around the surface or through the bulk of the ultra-small structure. If wall 212 is sufficiently thin, then the charge of the current will oscillate on both inside surface 214 and outside surface 216. The induced oscillating current engenders a varying electric field across the opening 218.

In some exemplary embodiments, ultra-small resonant structures 208 and 210 are positioned such that some component of the varying electric field induced across opening 218 exists parallel to the propagation direction of beam 204. The varying electric field across opening 218 modulates beam 204. The most effective modulation or energy transfer generally occurs when the charged electrons of beam 204 traverse the gap in the cavity in less time then one cycle of the oscillation of the ultra-small resonant structure.

In some exemplary embodiments, the varying electric field generated at opening 218 of ultra-small resonant structures 208 and 210 are parallel to beam 204. The varying electric field modulates the axial motion of beam 204 as beam 204 passes by ultra-small resonant structures 208 and 210. Beam 204 becomes a space-charge wave or a charge modulated beam at some distance from the resonant structure.

Ultra-small resonant structures can be built in many different shapes. The shape of the ultra-small resonant structure affects its effective inductance and capacitance. (Although traditional inductance an capacitance can be undefined at some of the frequencies anticipated, effective values can be measured or calculated.) The effective inductance and capacitance of the structure primarily determine the resonant frequency.

Ultra-small resonant structures 208 and 210 can be constructed with many types of materials. The resistivity of the material used to construct the ultra-small resonant structure may affect the quality factor of the ultra-small resonant structure. Examples of suitable fabrication materials include silver, high conductivity metals, and superconducting materials. The artisan will recognize that there are many suitable materials from which ultra-small resonant structure 208 may be constructed, including dielectric and semi-conducting materials.

An exemplary embodiment of a charged particle beam modulating ultra-small resonant structure is a planar structure, but there is no requirement that the modulator be fabricated as a planar structure. The structure could be non-planar.

Example methods of producing such structures from, for example, a thin metal are described in commonly-owned U.S. patent application Ser. No. 10/917,511 ("Patterning Thin Metal Film by Dry Reactive Ion Etching"). In that application, etching techniques are described that can produce the cavity structure. There, fabrication techniques are described that result in thin metal surfaces suitable for the ultra-small resonant structures 208 and 210.

Other example methods of producing ultra-small resonant structures are described in commonly-owned U.S. application Ser. No. 11/203,407, filed on Aug. 15, 2005 and entitled "Method of Patterning Ultra-Small Structures." Applications of the fabrication techniques described therein result in microscopic cavities and other structures suitable for high-frequency resonance (above microwave frequencies) including frequencies in and above the range of visible light.

Figure 3:
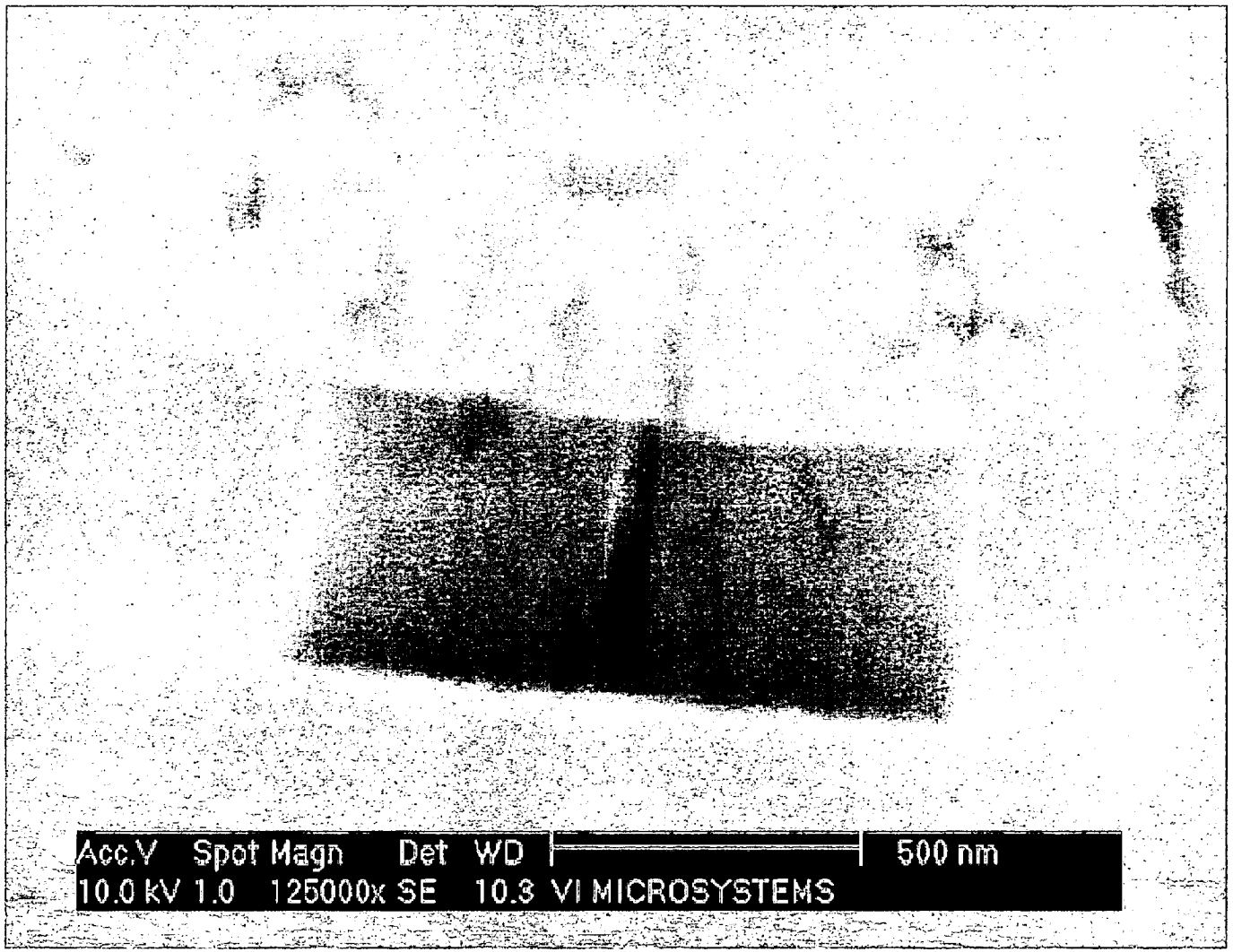
FIG. 3 is an electron microscope photograph illustrating an example ultra-small resonant structure according to embodiments of the present invention.
Figure 4:
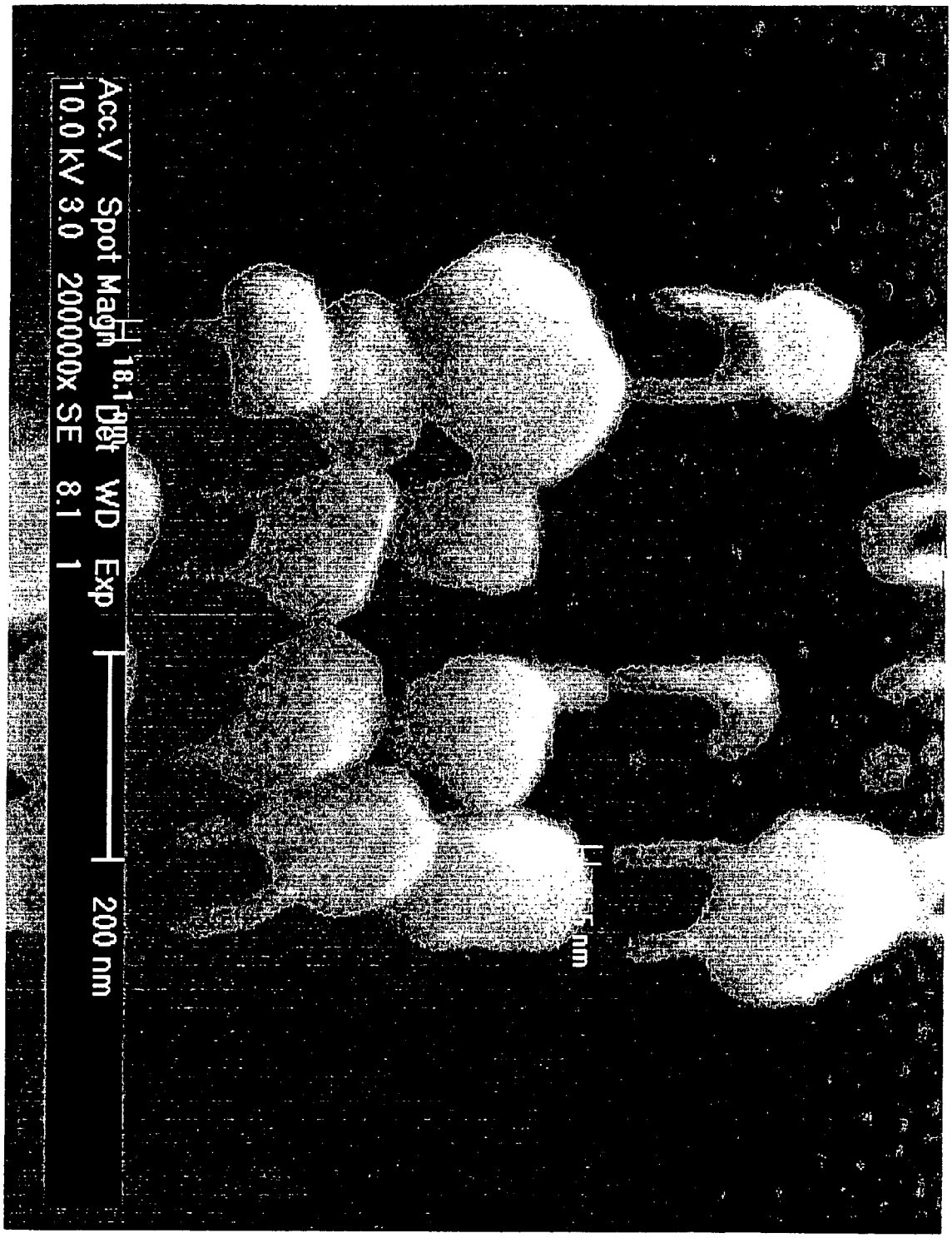
FIG. 4 is an electron microscope photograph illustrating the very small and very vertical walls for the resonant cavity structures according to embodiments of the present invention.

Such techniques can be used to produce, for example, the klystron ultra-small resonant structure shown in FIG. 3. In FIG. 3, the ultra-small resonant klystron is shown as a very small device with smooth and vertical exterior walls. Such smooth vertical walls can also create the internal resonant cavities (examples shown in FIG. 4) within the klystron. The slot in the front of the photo illustrates an entry point for a charged particle beam such as an electron beam. Example cavity structures are shown in FIG. 4, and can be created from the fabrication techniques described in the above-mentioned patent applications. The microscopic size of the resulting cavities is illustrated by the thickness of the cavity walls shown in FIG. 4. In the top right corner, for example, a cavity wall of 16.5 nm is shown with very smooth surfaces and very vertical structure. Such cavity structures can provide electron beam modulation suitable for higher-frequency (above microwave) applications in extremely small structural profiles.

Figure 5:
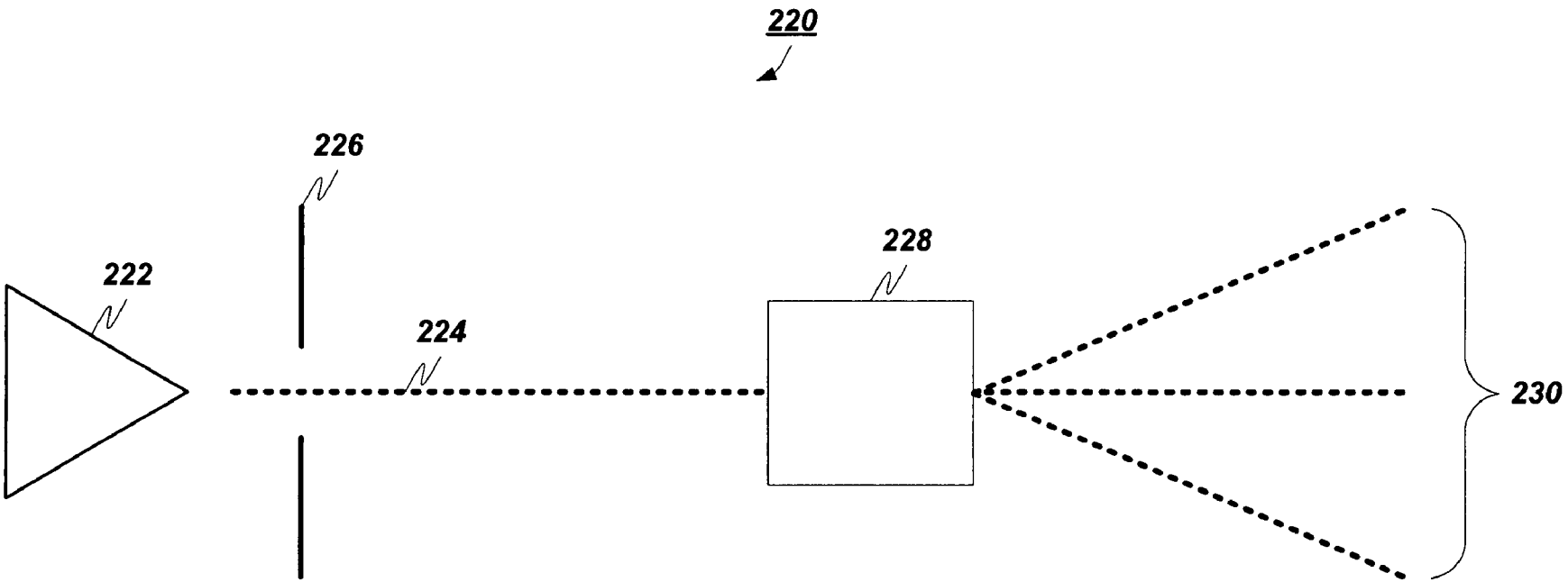
FIG. 5 shows a schematic of a charged particle modulator that angularly modulates a beam of charged particles according to embodiments of the present invention.

FIGS. 4 and 5 are provided by way of illustration and example only. The present invention is not limited to the exact structures, kinds of structures, or sizes of structures shown. Nor is the present invention limited to the exact fabrication techniques shown in the above-mentioned patent applications. A lift-off technique, for example, may be an alternative to the etching technique described in the above-mentioned patent application. The particular technique employed to obtain the ultra-small resonant structure is not restrictive. Rather, we envision ultra-small resonant structures of all types and microscopic sizes for use in the production of electromagnetic radiation and do not presently envision limiting our inventions otherwise.

FIG. 5 shows another exemplary embodiment of a charged particle beam modulator 220 according to embodiments of the present invention. In these embodiments, the source of charged particles 222 produces beam 224, consisting of one or more charged particles, which passes through bias structure 226.

Beam 224 passes by excited ultra-small resonant structure 228 positioned along the path of beam 224 such that some component of the varying electric field induced by the excitation of excited ultra-small resonant structure 228 is perpendicular to the propagation direction of beam 224.

The angular trajectory of beam 224 is modulated as it passes by ultra-small resonant structure 228. As a result, the angular trajectory of beam 224 at some distance beyond ultra-small resonant structure 228 oscillates over a range of values, represented by the array of multiple charged particle beams (denoted 230).

Figure 6A:
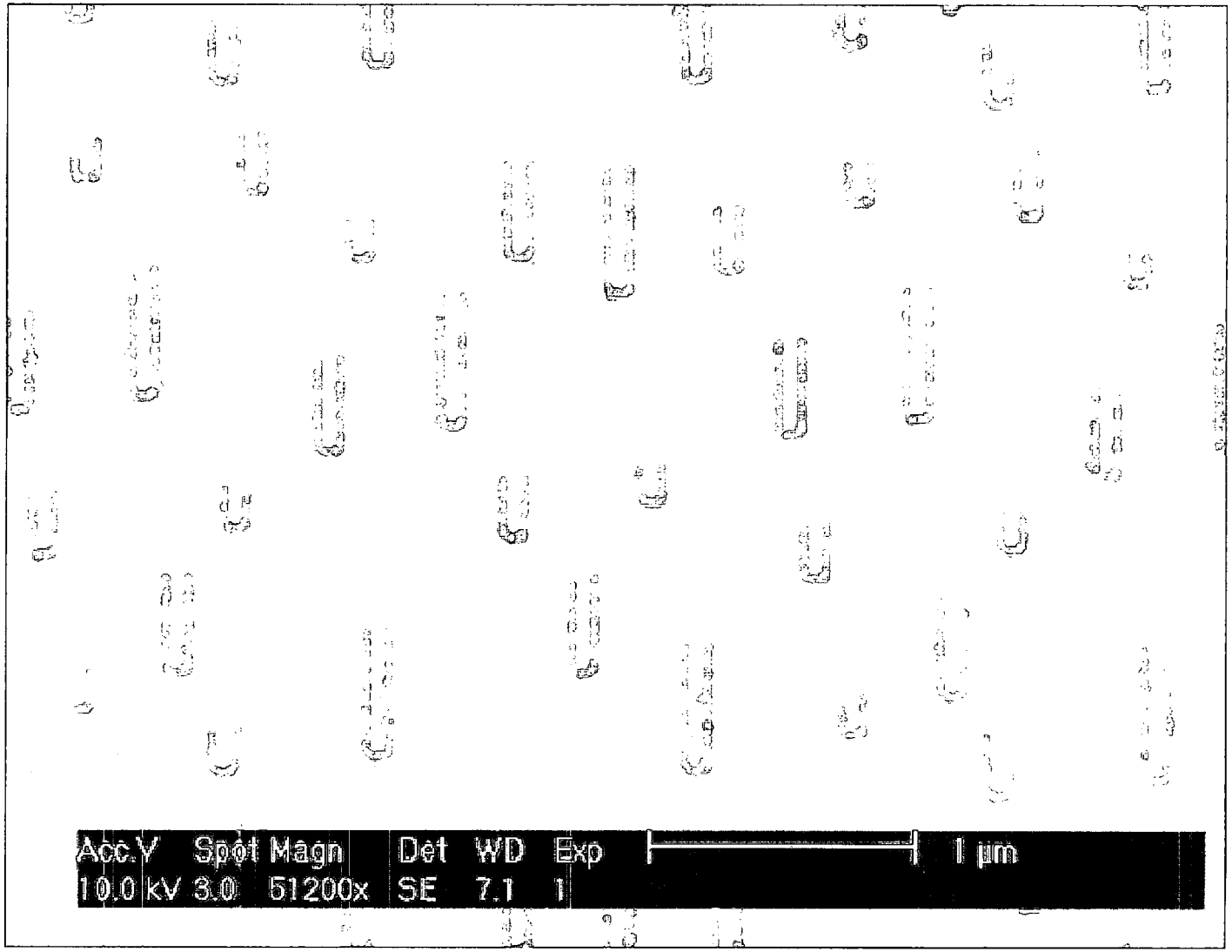
FIGS. 6(*a*)-6(*c*) are electron microscope photographs illustrating various exemplary structures according to embodiments of the present invention.
Figure 6B:
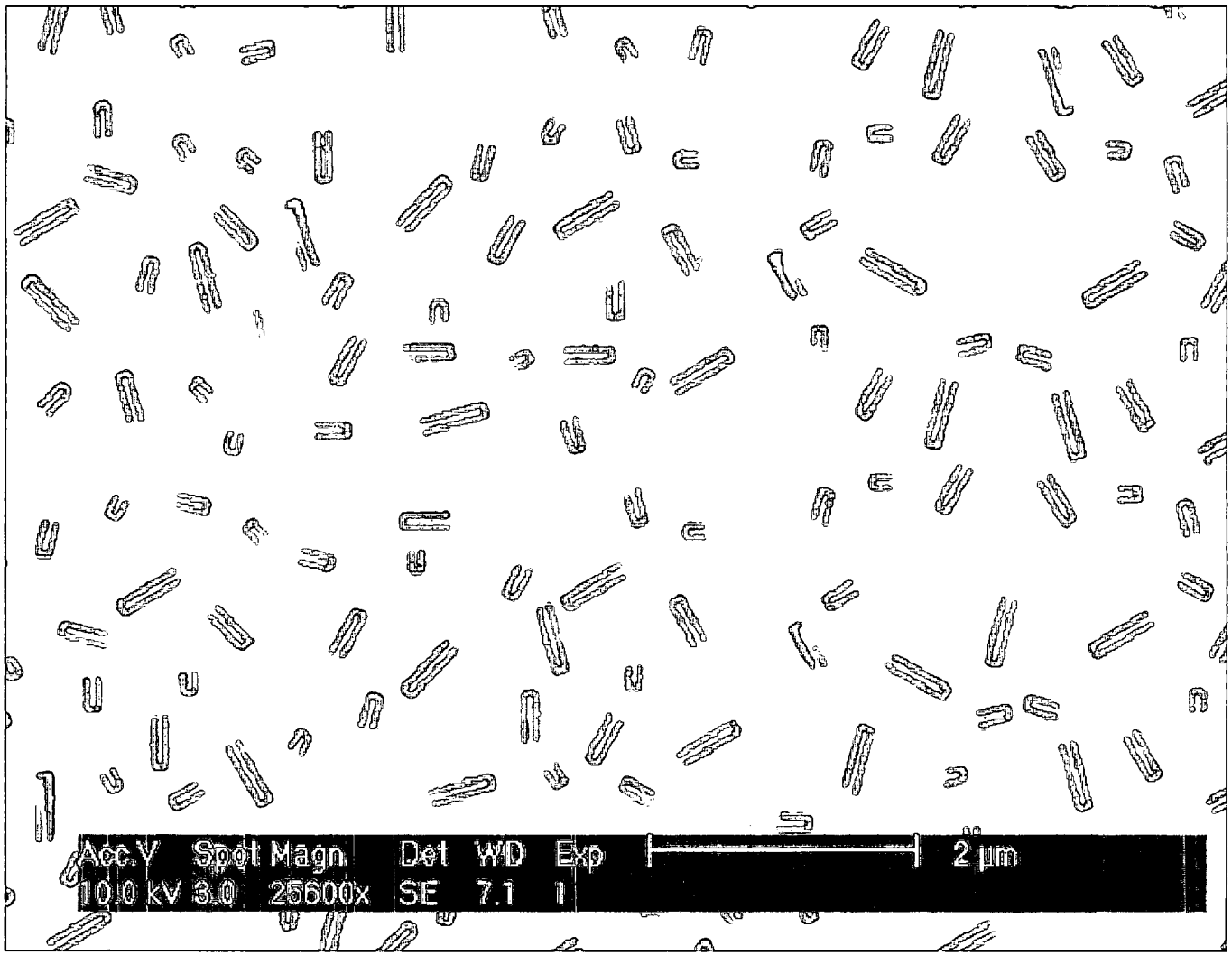
Figure 6C:
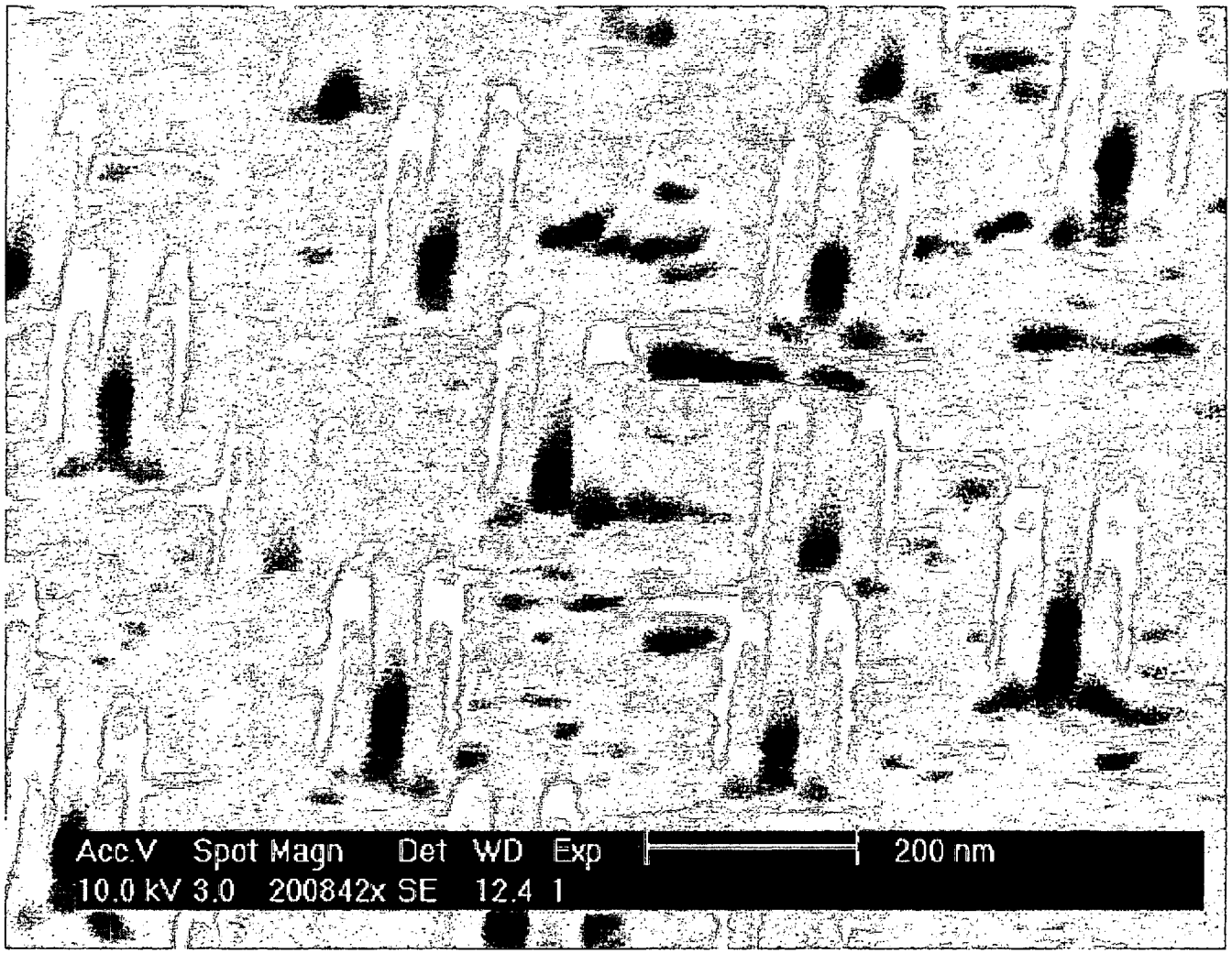

FIGS. 6(*a*)-6(*c*) are electron microscope photographs illustrating various exemplary structures operable according to embodiments of the present invention. Each of the figures shows a number of U-shaped cavity structures formed on a substrate. The structures may be formed, e.g., according to the methods and systems described in related U.S. patent application Ser. No. 10/917,511, filed on Aug. 13, 2004, entitled "Patterning Thin Metal Film by Dry Reactive Ion Etching," and U.S. application Ser. No. 11/203,407, filed on Aug. 15, 2005, entitled "Method of Patterning Ultra-Small Structures," both of which are commonly owned with the present application at the time of filing, and the entire contents of each of have been incorporated herein by reference.

Thus are described ultra-small resonating charged particle beam modulators and the manner of making and using same. While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A device comprising:

a source providing a beam of charged particles in a direction; and a plurality of ultra-small resonant structures collectively inducing a varying electric field when exposed to incoming electromagnetic radiation having a frequency in excess of the microwave frequency and each ultra-small resonant structure embodying at least one dimension in the direction of the beam that is smaller than the wavelength of visible light, whereby said beam of charged particles passes by the ultra-small resonant structures and is modulated by interacting with said varying electric field as it passes by the ultra-small resonant structures.

2. The device of claim 1 wherein each said ultra-small resonant structure is a cavity.

3. The device of claim 1 wherein each said ultra-small resonant structure is a surface plasmon resonant structure.

4. The device of claim 1 wherein each said ultra-small resonant structure is a plasmon resonating structure.

5. The device of claim 1 wherein each said ultra-small resonant structure has a semi-circular shape.

6. The device of claim 1 wherein each said ultra-small resonant structure is symmetric.

7. The device of claim 1 wherein said varying electric field of said resonant structure modulates the angular trajectory of said electron beam.

8. The device of claim 1 wherein said varying electric field of said ultra-small resonant structure modulates the axial motion of said electron beam.

9. The device of claim 1 wherein each said ultra-small resonant structure is a cavity filled with a dielectric material.

10. The device of claim 1 wherein said charged particles are selected from the group comprising: electrons, protons, and ions.

11. The device of claim 1 wherein said source of charged particles is a source selected from the group comprising: an ion gun, a tungsten filament, a cathode, a planar vacuum triode, an electron-impact ionizer, a laser ionizer, a chemical ionizer, a thermal ionizer, an ion-impact ionizer.

12. The device of claim 1 wherein each said ultra-small resonant structure is constructed of a material selected from the group comprising: silver (Ag), copper (Cu), a conductive material, a dielectric, a transparent conductor; and a high temperature superconducting material.

13. A method of modulating a beam of charged particles traveling in a direction, comprising:

providing a plurality of ultra-small resonant structures each embodying at least one dimension in the direction of the beam that is smaller than the wavelength of visible light;

inducing a varying electric field at the ultra-small resonant structure by exposing the ultra-small resonant structures to incoming electromagnetic radiation having a frequency in excess of the microwave frequency; and modulating said beam of charged particles by the interaction of said varying electric field with said beam of charged particles as the beam of charged particles passes by the ultra-small resonant structures.

14. The method of modulating a beam of charged particles of claim 13 wherein said step of inducing includes inducing the varying electric field at a cavity.

15. The method of modulating a beam of charged particles of claim 13 wherein said step of inducing includes inducing the varying electric field at a surface plasmon resonant structure.

16. The method of modulating a beam of charged particles of claim 13 wherein said step of inducing includes inducing the varying electric field at a semi-circular shaped structure.

17. The method of modulating a beam of charged particles of claim 13 wherein said step of inducing includes inducing the varying electric field at a symmetrical structure.

18. The method of modulating a beam of charged particles of claim 13 wherein said step of inducing includes inducing the varying electric field at an asymmetrical structure.

19. The method of modulating a beam of charged particles of claim 13 wherein said varying electric field of said resonant structure modulates the angular trajectory of said electron beam.

20. The method of modulating a beam of charged particles of claim 13 wherein said varying electric field of said ultra-small resonant structures modulates the axial motion of said electron beam.

21. The method of modulating a beam of charged particles of claim 13 wherein said step of inducing includes inducing the varying electric field at a cavity filled with a dielectric material.

22. The method of modulating a beam of charged particles of claim 13 wherein said beam of charged particles comprises a beam of electrons.

23. The method of modulating a beam of charged particles of claim 13 wherein said beam of charged particles comprises a beam of protons.

24. The method of modulating a beam of charged particles of claim 13 wherein said beam of charged particles comprises a beam of ions.

25. The method of modulating a beam of charged particles of claim 13 wherein said beam of charged particles is produced by a device selected from the group comprising: an ion gun; a tungsten filament; a cathode; a planar vacuum triode having a large parasitic capacitance; an electron-impact ionizer; a laser ionizer; a chemical ionizer; a thermal ionizer; and an ion-impact ionizer.

26. The method of modulating a beam of charged particles of claim 13 wherein said step of inducing includes inducing the varying electric field at a silver resonant structure.

27. The method of modulating a beam of charged particles of claim 13 wherein said step of inducing includes inducing the varying electric field at a high temperature superconducting material.

* * * * *